US005330887A

United States Patent [19]

Hasebe et al.

[11] Patent Number: 5,330,887

[45] Date of Patent: Jul. 19, 1994

[54] SILVER HALIDE COLOR PHOTOGRAPHIC MATERIALS CONTAINING COMBINATIONS OF MAGENTA COUPLERS AND SENSITIZING DYES

[75] Inventors: Kazunori Hasebe; Kiyoshi Nakazyo, both of Kanagawa, Japan

[73] Assignee: Fuji Photo Film Co., Ltd., Kanagawa, Japan

[21] Appl. No.: 905,136

[22] Filed: Jun. 23, 1992

Related U.S. Application Data

[63] Continuation of Ser. No. 212,744, Jun. 28, 1988, abandoned.

[30] Foreign Application Priority Data

Jun. 30, 1987 [JP] Japan ..... 62-163569

[51] Int. Cl.[5] ..... G03C 1/18; G03C 7/38; G03C 1/035

[52] U.S. Cl. ..... 430/550; 430/551; 430/558; 430/567; 430/585; 430/588

[58] Field of Search ..... 430/558, 550, 588, 551, 430/585, 567

[56] References Cited

U.S. PATENT DOCUMENTS

| | | | |
|---|---|---|---|
| 4,588,679 | 5/1986 | Furutachi | 430/551 |
| 4,741,995 | 5/1988 | Tani et al. | 430/558 |
| 4,764,456 | 8/1988 | Watanabe et al. | 430/550 |
| 4,830,956 | 5/1989 | Waki | 430/558 |
| 4,857,444 | 8/1989 | Hirose et al. | 430/558 |

FOREIGN PATENT DOCUMENTS

| | | | |
|---|---|---|---|
| 0226849 | 7/1987 | European Pat. Off. . | |
| 1243451 | 10/1986 | Japan | 430/550 |
| 2229146 | 10/1987 | Japan | 430/558 |

*Primary Examiner*—Lee C. Wright
*Attorney, Agent, or Firm*—Sughrue, Mion, Zinn, Macpeak & Seas

[57] ABSTRACT

A silver halide color photographic material comprising a support having on one side thereof at least one silver halide emulsion layer corresponding to each of the colors cyan, magenta, and yellow in which each of the colors cyan, magenta and yellow, respectively, are formed, wherein the layer which forms a magenta color is a green sensitive layer comprising (A) at least one coupler represented by formula (I) or formula (II) below Formula (I)

Formula (II)

wherein $R_1$, $R_2$, $R'_2$ and X are as defined in the above specification and (B) silver halide grains which have been spectrally sensitized in such a way that they have a peak sensitivity between 540 nm and 555 nm by at least one spectrally sensitizing dye represented by the formulae (A), (B) and (C) below (A)

(B)

(Abstract continued on next page.)

-continued

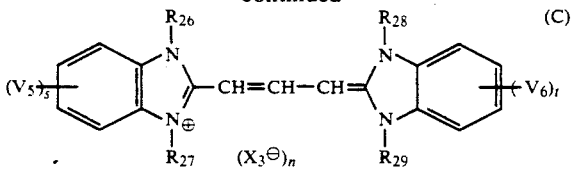

(C)

wherein $W_1$, $W_2$, $V_1$, $V_2$, $V_3$, $V_4$, $V_5$, $V_6$, $R_{21}$, $R_{22}$, $R_{23}$, $R_{24}$, $R_{25}$, $R_{26}$, $R_{27}$, $R_{28}$, $R_{29}$, Y, $X_1$, $X_2$, $X_3$ and the subscripts, l, m, n, o, p, q, r, s and t are defined as in the above specification, with the proviso that at least one of $R_{21}$ and $R_{22}$; at least one of $R_{23}$, $R_{24}$ and $R_{25}$; or at least one of $R_{26}$, $R_{27}$, $R_{28}$ and $R_{29}$ represents an alkyl group or an aralkyl group which contains a sulfo group or a salt thereof a carboxyl group or a salt thereof, or a hydroxyl group provided that the speed at the spectral sensitivity peak wavelength of the green sensitive layer is twice or more of the speed at 500 nm.

22 Claims, No Drawings

SILVER HALIDE COLOR PHOTOGRAPHIC MATERIALS CONTAINING COMBINATIONS OF MAGENTA COUPLERS AND SENSITIZING DYES

This is a continuation of application Ser. No. 07/212,744, filed Jun. 28, 1988, now abandoned.

FIELD OF THE INVENTION

The present invention concerns silver halide color photographic materials, and more precisely it concerns silver halide color photographic materials which contain combinations of magenta couplers and sensitizing dyes, which have good color forming properties, improved color reproduction and image storage properties, and excellent stability with respect to ageing and and manufacturing stability.

BACKGROUND OF THE INVENTION

Yellow, magenta and cyan tri-color photographic couplers are generally included in the light-sensitive layers and the color development processing of the exposed photographic material is carried out using so-called color developing agents in order to form a color photographic image. Colored dyes are provided by a coupling reaction between the oxidation product of an aromatic primary amine and the couplers. Systems which have as high a coupling rate as possible and which have good color forming properties are preferred for forming high color densities within a limited development time. Moreover, the colored dyes should be brilliant cyan, magenta and yellow dyes with little in the way of subsidiary absorptions (side-absorptions) to provide color photographic images which have good color reproduction.

On the other hand, the color photographic image which is formed must have good storage properties under various conditions. These storage conditions include dark storage conditions where the color photographic image is affected by heat and humidity and illuminated storage conditions where there is exposure to sunlight or indoor lighting, etc., and not only changes in the color of the color image, but also yellowing of the white background are of great importance.

The couplers which function as color image forming agents play an important role here, and much work has gone into making improvements by modifying the coupler structure with a view of satisfying the requirements of color photographic materials as outlined above. Conventionally 5-pyrazolone derivatives have been used in the main for the magenta couplers which are important from the viewpoint of visual sensitivity, but the dye images formed from these couplers have an absorption not only in the green light region as intended, but also unwanted absorptions in the blue and red light regions and they cannot be said to perform satisfactorily. Furthermore, the 5-pyrazolone derivatives are liable to yellowing on exposure to light and under conditions of high humidity and they are unsatisfactory from the viewpoint of image storage properties.

The magenta couplers represented by formulae (I) and (II) shown below are excellent couplers in that they are superior with respect to the light absorbing properties of the dye image and in that there is little yellowing of the white background, but they are liable to give rise to reduced speed during development and, in particular, there is a serious practical difficulty in that this trend becomes more pronounced as the coating liquid ages during the manufacture of the photographic material and when the coated photographic material is stored for an extended period of time.

The spectral sensitivity distribution obtained by spectral sensitization is of importance from the viewpoint of color reproduction. The spectral sensitivity distribution of a film material (a photographic material for taking a photograph) is preferably such that it is able to reproduce colors with a fidelity as approaching the human visual sensitivity distribution, but the circumstances are quite different from those of film material in the case of a print material (a photographic material for print). A print material is normally exposed through the cyan, magenta and yellow color dye image of a negative or positive film material and so it must have spectral sensitivity peaks corresponding to the hues of each of the color dyes in the negative or positive material.

The absorption spectrum of the magenta dyes in a film material normally has a peak wavelength between 540 nm and 555 nm and it has long been known that the preferred spectral sensitivity peak wavelength of the green sensitive layer of a print material corresponds to this region, but with the combinations of this invention, it has been found that the speed at 500 nm of the green sensitive layer is also of great importance with respect to color reproduction.

That is to say, the magenta couplers utilized in the present invention give a very sharp hue and so the colors such as red, green, blue, etc., can be reproduced with a high brilliance but, on the other hand, the colors of the green color system have often tended to reproduce as dark colors.

As a result of thorough investigation, it has been found that this tendency of the colors of the green color system to be reproduced as dark colors has a corresponding relationship with the speed at 500 nm of the green sensitive layer.

SUMMARY OF THE INVENTION

The object of the present invention is to provide photographic materials which simultaneously satisfy the above mentioned functions which are required of a color photographic material. In more practical terms, the first object of the present invention is to provide color photographic materials which have excellent color reproduction by combining good spectral sensitivity characteristics with magenta color images which have good light absorption characteristics.

The second object of the present invention is to provide color photographic materials in which the color image is fast during storage in the dark and under illumination and which has improved white background staining characteristics.

The third object of the present invention is to provide color photographic materials with which there is no fogging or loss of speed at the time of development.

The fourth object of the present invention is to provide color photographic materials of which there is no variation in performance due to ageing of the coating liquid during manufacture or during storage of the coated photographic material.

Other objects of the present invention will become apparent from the description provided below.

The objects described above have been achieved by means of a silver halide color photographic material comprising a support having on one side thereof at least one silver halide emulsion layer corresponding to each of the colors cyan, magenta, and yellow in which each of the colors cyan, magenta and yellow, respectively, are formed, wherein the layer which forms a magenta color is a great sensitive layer comprising:

(A) at least one coupler represented by formula (I) or formula (II) below

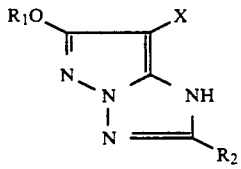

(I)

wherein $R_1$ represents an alkyl group, an aryl group or a heterocyclic group;

$R_2$ represents a hydrogen atom or a substituent group; and

X represents a hydrogen atom or a coupling elimination group;

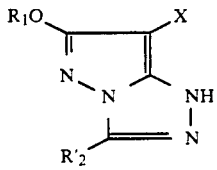

(II)

wherein $R_1$ is defined the same as $R_1$ in formula (I):

$R'_2$ represents an alkyl group, an aryl group, an alkylthio group, an arylthio group or a heterocyclicthio group; and X is defined the same as in formula (I); and (B) silver halide grains which have been spectrally sensitized in such a way that they have a peak sensitivity between 540 nm and 555 nm by at least one spectrally sensitizing dye represented by the formulae (A), (B) and (C) below

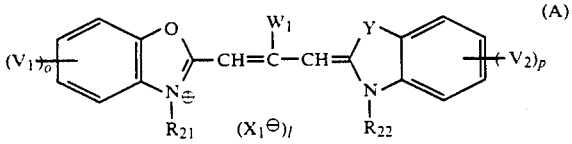

(A)

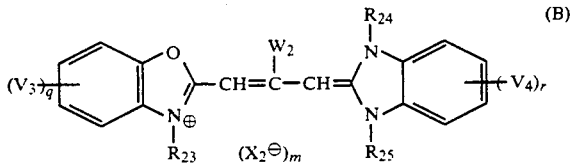

(B)

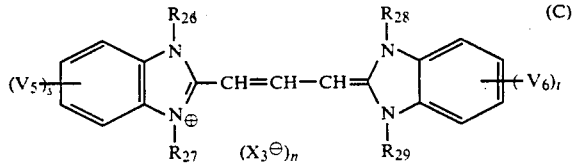

(C)

wherein $W_1$ and $W_2$ each represents a hydrogen atom or an alkyl group;

$V_1$, $V_2$, $V_3$ and $V_4$ each represents a hydrogen atom, a halogen atom, an alkyl group, an aryl group, an alkoxy group, an amido group, an alkoxycarbonyl group or a cyano group;

$V_1$ and V2, or $V_3$ and $V_4$ may be the same or different, and they may represent a condensed benzene ring;

$V_5$ and $V_6$ may be the same or different and each represents a hydrogen atom, a halogen atom, an alkyl group, an alkoxy group, an amido group, an alkoxycarbonyl group or a cyano group;

the subscripts o, p, q, r, s and t each represents an integer of from 1 to 4 and when the subscripts each represents an integer of from 2 to 4, $V_1$'s, $V_2$'s, $V_3$'s, or $V_4$'s may be the same or different;

$R_{21}$, $R_{22}$, $R_{23}$, $R_{24}$, $R_{25}$, $R_{26}$, $R_{27}$, $R_{28}$ and $R_{29}$ each represents an alkyl group or an aralkyl group, provided that at least one of $R_{21}$ and $R_{22}$; at least one of $R_{23}$, $R_{24}$ and $R_{25}$; or at least one of $R_{26}$, $R_{27}$, $R_{28}$ and $R_{29}$ represents an alkyl group or an aralkyl group which contains a sulfo group or a salt thereof, a carboxyl group or a salt thereof, or a hydroxyl group;

Y represents an oxygen atom or a sulfur atom;

$X_1$, $X_2$ and $X_3$ represent acid anions; and l, m and n represent 0 or 1, and Z, m and n represent 0 when each compound is an intramolecular salt;

provided that the speed at the spectral sensitivity peak wavelength of the green sensitive layer is twice or more of the speed at 500 nm.

DETAILED DESCRIPTION OF THE INVENTION

In formulae (I) and (II), $R_1$ represents a substituted or unsubstituted alkyl group such as methyl, ethyl, isopropyl, t-butyl, trifluoromethyl, phenylmethyl, methoxyethyl, 2-phenoxyethyl, 2-methylsulfonylethyl, 2-hydroxyethyl, 3,3,3-trifluoropropyl, 2-fluoroethyl, 2-chloroethyl, 2-bromoethyl, 2-cyanoethyl, 3-oxobutyl, a substituted or unsubstituted aryl group such as phenyl, 4-methylphenyl, 4-t-butylphenyl, 4-acylaminophenyl, 4-halogenophenyl, 4-alkoxyphenyl, or a heterocyclic group (for example, a 5- or 6-membered heterocyclic group containing one or more hetero atoms selected from the groups consisting of oxygen, nitrogen and sulfur atoms which may be substituted and/or condensed) such as 2-furyl, 2-thienyl, 2-pyrimidinyl, 2-benzothiazolyl, 2-pyridyl, 3-pyridyl, 4-pyridyl.

$R_2$ represents a hydrogen atom, halogen atom (for example, chlorine, bromine), an alkyl group [for example, a substituted alkyl group such as a sulfonamido substituted alkyl group (sulfonamidomethyl, 1-sulfonamidoethyl, 2-sulfonamidoethyl, 1-methyl-2-sulfonamidoethyl, 3-sulfonamidopropyl), an acylamino substituted alkyl group (acylaminomethyl, 1-acylaminoethyl, 2-acylaminoethyl, 1-methyl-2-acylaminoethyl, 3-acylaminopropyl), a sulfonamido substituted phenylalkyl group (p-sulfonamidophenylmethyl, p-sulfonamidophenylethyl, 1-(p-sulfonamidophenyl)ethyl, p-sulfonamidophenylpropyl), an acylamino substituted phenylalkyl group (p-acylaminophenylmethyl, p-acylaminophenylethyl, 1-(p-acylaminophenyl)ethyl, p-acylaminophenylpropyl), an alkylsulfonyl substituted alkyl group (2-dodecylsulfonylethyl, 1-methyl-2-pentadecylsulfonylethyl, octadecylsulfonylpropyl), a phenylsulfonyl substituted alkyl group (3-(2-butyl-5-t-octylphenylsulfonyl)propyl, 2-(4-dodecyloxyphenylsulfonyl)ethyl) or an unsubstituted alkyl group such as methyl, ethyl, hexyl, dodecyl], an aryl group (for example, a substituted aryl group such as a sulfonamidophenyl group, an acylaminophenyl group, an alkoxyphenyl group, an aryloxyphenyl group, a substituted alkylphenyl group, a sulfonamidonaphthyl group, an acylaminonaphthyl group, etc., or an unsubstituted aryl group such as phenyl, naphthyl), a heterocyclic group (for example, a 5- or 6-membered heterocyclic group containing one or more hetero atoms selected from the groups consisting of oxygen, nitrogen and sulfur atoms which may be substituted and/or condensed) (such as 2-furyl, 2-thienyl, 2-pyrimidyl, 2-benzothiazolyl), a cyano group, an alkoxy group (for example, methoxy, ethoxy, 2-methoxyethoxy, 2-dodecylethoxy, 2-methanesulfonylethoxy), an aryloxy group (for example, phenoxy, 2-methylphenoxy, 4-t-butylphenoxy), an acylamino group (for example, acetamido, benzamido, tetradecanamido, α-(2,4-di-t-amylphenoxy)butylamido, γ-(3-t-butyl-4-hydroxyphenoxy)butylamido, α-{4-(4-hydroxyphenylsulfonyl)phenoxy}decanamido), an anilino group (for example, phenylamino, 2-chloroanilino, 2-chloro-5-tetradecanamidoanilino, 2-chloro-5-dodecyloxycarbonylanilino, N-acetylanilino, 2-chloro-5-{α-(3-t-butyl-4-hydroxyphenoxy)-dodecanamido}anilino), a ureido group (for example, phenylureido, methylureido, N,N-dibutylureido), a sulfamoylamino group (for example, N,N-dipropylsulfamoylamino, N-methyl-n-decylsulfamoylamino), an alkylthio group (for example, methylthio, octylthio, tetradecylthio, 2-phenoxyethylthio, 3-phenoxypropylthio, 3-(4-t-butylphenoxy)propylthio), an arylthio group (for example, phenylthio, 2-butoxy-5-t-octylphenylthio, 3-pentadecylphenylthio, 2-carboxyphenylthio, 4-tetradecanamidophenylthio), an alkoxycarbonylamino group (for example, methoxycarbonylamino, tetradecyloxycarbonylamino), a sulfonamido group (for example, methanesulfonamido, hexadecanesulfonamido, benzenesulfonamido, p-toluenesulfonamido, octadecanesulfonamido, 2-methoxy-5-t-butylbenzenesulfonamido), a carbamoyl group (for example, N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a sulfonyl group (for example, methanesulfonyl, octanesulfonyl, benzenesulfonyl, toluenesulfonyl) or an alkoxy carbonyl group (for example, methoxycarbonyl, butyloxycarbonyl, dodecyloxycarbonyl, octadecyloxycarbonyl), and of these groups, the alkyl groups, aryl groups, alkylthio groups and arylthio groups are preferred and, of these, the alkyl groups and aryl groups are the most desirable.

$R'_2$ represents a substituted alkyl group such as a sulfonamido substituted alkyl group (for example, sulfonamidomethyl, 1-sulfonamidoethyl, 2-sulfonamidoethyl, 1-methyl-2-sulfonamidoethyl, 3-sulfonamidopropyl), an acylamino substituted alkyl group (for example, acylaminomethyl, 1-acylaminoethyl, 2-acylaminoethyl, 1-methyl-2-acylaminoethyl, 3-acylaminopropyl), a sulfonamido substituted phenylalkyl group (for example, p-sulfonamidophenylmethyl, p-sulfonamidophenylethyl, 1-(p-sulfonamidophenyl)ethyl, p-sulfonamidophenylpropyl), an acylamino substituted phenylalkyl group (for example, p-acylaminophenylmethyl, p-acylaminophenylethyl, 1-(p-acylaminophenyl)ethyl, p-acylaminophenylpropyl), an alkylsulfonyl substituted alkyl group (for example, 2-dodecylsulfonylethyl, 1-methyl-2-pentadecylsulfonylethyl, octadecylsulfonylpropyl), a phenylsulfonyl substituted alkyl group (for example, 3-(2-butyl-5-t-octylphenylsulfonyl)propyl, 2-(4-dodecyloxyphenylsulfonylethyl), etc., or an unsubstituted alkyl group such as methyl, ethyl, hexyl, dodecyl, a substituted aryl group such as a sulfonamidophenyl group, acylaminophenyl group, alkoxyphenyl group, aryloxyphenyl group, substituted alkylphenyl group, sulfonamidonaphthyl group, acylaminonaphthyl group, etc., or an unsubstituted aryl group such as phenyl, naphthyl, an alkylthio group (for example, methylthio, octylthio, tetradecylthio, 2-phenoxyethylthio, 3-phenoxypropylthio, 3-(4-t-butylphenoxy)propylthio), an arylthio group (for example, phenylthio, 2-butoxy-5-t-octylphenylthio, 3-pentadecylphenylthio, 2-carboxyphenylthio, 4-tetradecanamidophenylthio), or a heterocyclic group (for example, a 5- or 6-membered heterocyclic group containing one or more hetero atoms selected from the groups consisting of oxygen, nitrogen and sulfur atoms which may be substituted and/or condensed) (such as 2-benzothiazolylthio, 2,4-diphenoxy-1,3,5-triazole-6-thio, 2-pyridylthio), etc.

Of these groups, the substituted alkyl groups and substituted aryl groups are preferred and the substituted alkyl groups are the most desirable.

X represents a hydrogen atom, halogen atom (for example, chlorine, bromine, iodine), a carboxyl group or a group which is linked by an oxygen atom (for example, actoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy), a group which is linked by a nitrogen atom (for example, benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoyl-amino, 1-piperidyl, 5,5-dimethyl-2,4-dioxo-3-oxazolidinyl, 1-benzyl-ethoxy-3-hydantoinyl, 2N-1,1-dioxo-3(2H)-oxo-1,2-benzoisothiazolyl, 2-oxo-1,2-dihydro-1-pyridinyl, imidazolyl, pyrazolyl, 3,5-diethyl-1,2,4-triazol-1-yl, 5- or 6-bromo-benzotriazol-1-yl, 5-methyl-1,2,3,4-tetrazol-1-yl, benzimidazolyl), or a group which is linked with a sulfur atom ( for example, phenylthio, 2-carboxyphenylthio, 2-methoxy-5-t-octylphenylthio, 4-methanesulfonylphenylthio, 4-octanesulfonamidophenylthio, benzylthio, 2-cyanoethylthio, 1-ethoxycarbonyltridecylthio, 5-phenyl-2,3,4,5-tetrazolylthio, 2-benzothiazolyl).

Any of $R_1$, $R_2$, $R'_2$ and X may represent a divalent group, and when a dimer is formed, then $R_1$, $R_2$ or $R'_2$ may represent a substituted or unsubstituted alkylene group (for example, methylene, ethylene, 1,10-decylene), a substituted or unsubstituted alkylene ether group (for example, $—CH_2CH_2—O—CH_2CH_2—$), or a substituted or unsubstituted phenylene group (for example, 1,4-phenylene, 1,3-phenylene,

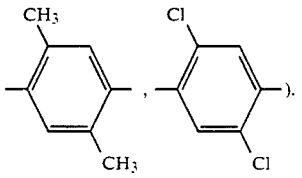

and X represents a divalent group which the above mentioned univalent groups are changed at an appropriate position thereof.

Linking groups which can be represented by any of $R_1$, $R_2$ or $R'_2$ when the compounds represented by the formulae (I) and (II) are contained in a vinyl monomer, include groups consisting of combinations selected from among the alkylene groups (substituted or unsubstituted alkylene groups, for example, methylene, ethylene, 1,10-decylene), the substituted or unsubstituted alkylene ether groups (substituted or unsubstituted alkylene ether groups, for example, $—CH_2CH_2OCH_2CH_2—$), the phenylene groups (substituted or unsubstituted phenylene groups, for example, 1,4-phenylene, 1,3-phenylene,

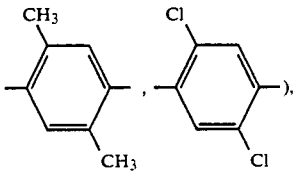

—NHCO— group, —CONH— group, —O— group, —OCO— group, and the aralkylene groups (for example,

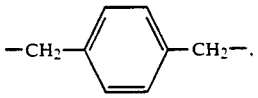

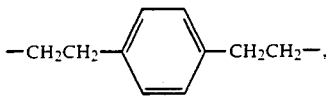

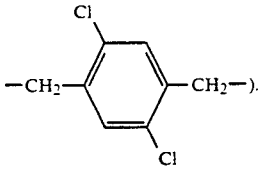

Preferred linking groups are indicated below.

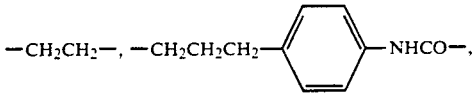

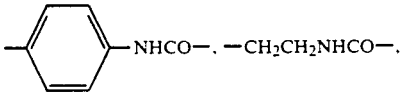

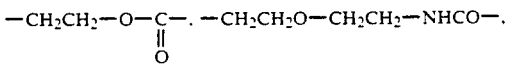

-continued

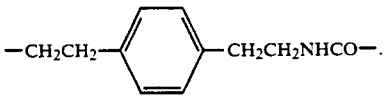

Moreover, the vinyl group may have substituent groups other than those indicated by formula (I), and the preferred substituent groups are a hydrogen atom, a chlorine atom or a lower alkyl group which has from 1 to 4 carbon atoms (for example, methyl, ethyl).

The monomers which contain units indicated by formulae (I) and (II) may form copolymers with non-color forming ethylenic monomers which do not couple with the oxidation products of aromatic primary amine developing agents.

Non-color forming ethylenic monomers which do not couple with the oxidation products of aromatic primary amine developing agents include acrylic acid, α-chloroacrylic acid, α-alkylacrylic acids (for example, methacrylic acid, etc.), and esters and amides derived from these acrylic acids (for example, acrylamide, n-butylacrylamide, t-butylacrylamide, diacetoneacrylamide, methacrylamide, methyl acrylate, ethyl acrylate, n-propyl acrylate, n-butyl acrylate, t-butylacrylate, isobutyl acrylate, 2-ethylhexyl acrylate, n-octyl acrylate, lauryl acrylate, methyl methacrylate, ethyl methacrylate, n-butyl methacrylate and β-hydroxymethacrylate), methylenedibis acrylamide, vinyl esters (for example, vinyl acetate, vinyl propionate and vinyl laurate), acrylonitrile, methacrylonitrile, aromatic vinyl compounds (for example, styrene and derivatives thereof, vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid, maleic anhydride, maleic acid esters, N-vinyl-2-pyrrolidone, N-vinylpyridine and 2- and 4-vinylpyridine, etc. Two or more of the non-color forming ethylenically unsaturated monomers can be used conjointly. For example, n-butyl acrylate and methyl acrylate, styrene and methacrylic acid, methacrylic acid and acrylamide, methyl acrylate and diacetoneacrylamide, etc. can be used.

As is well known in the field of polymeric color couplers, the non-color forming ethylenically unsaturated monomers for copolymerization with solid water-insoluble monomer couplers can be selected in such a way that the physical properties and/or chemical properties of the copolymer which is formed, for example its solubility, compatibility with binding agents such as gelatin for example which are used in photographic colloid compositions, flexibility and thermal stability, etc., are beneficially affected.

The polymeric couplers which are used in the present invention may be water-soluble or water-insoluble, but of these materials, the polymeric coupler latexes are especially desirable.

The couplers represented by formula (I) or (II) used in the present invention can be synthesized with reference to the methods described in, for example, European Patent 0,226,849.

Actual examples of typical magenta couplers within the scope of this invention are indicated below, but the present invention is not limited to these couplers.

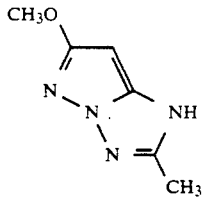
(1)
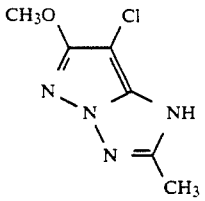
(2)
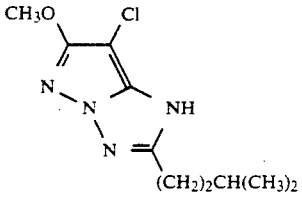
(3)
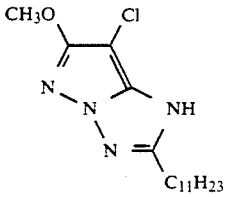
(4)
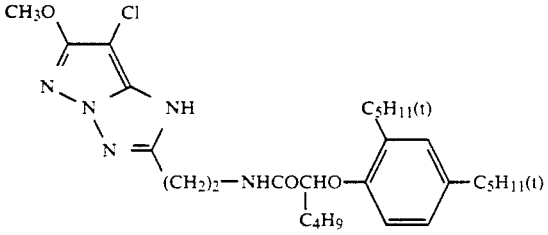
(5)
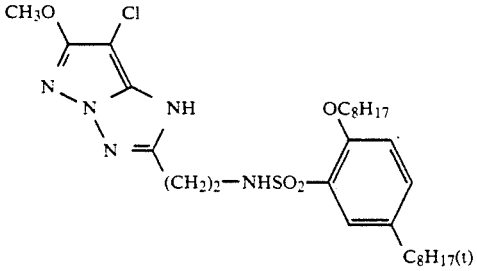
(6)
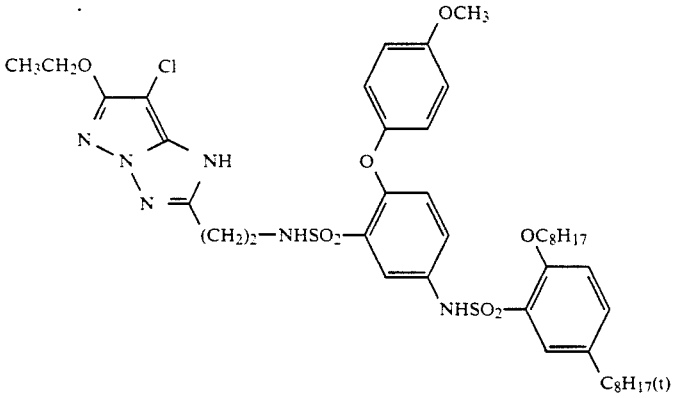
(7)
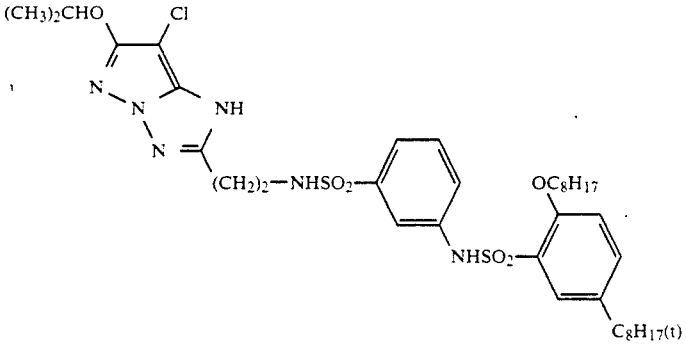
(8)

-continued
(9)
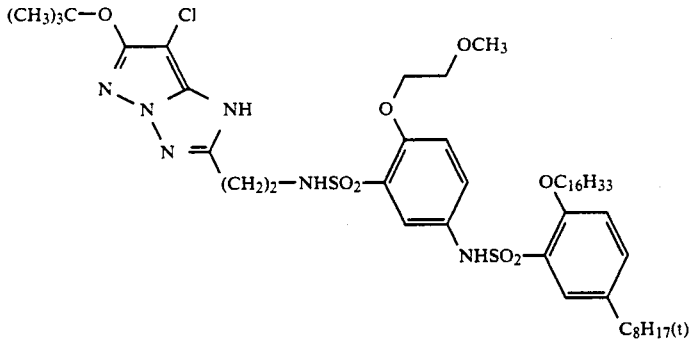
(10)
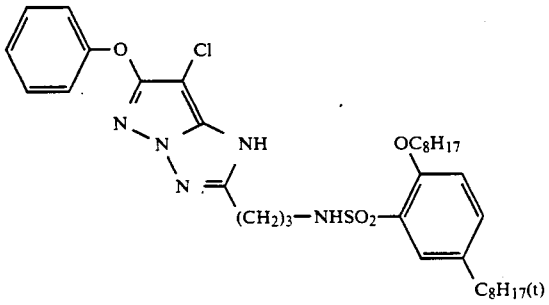
(11)
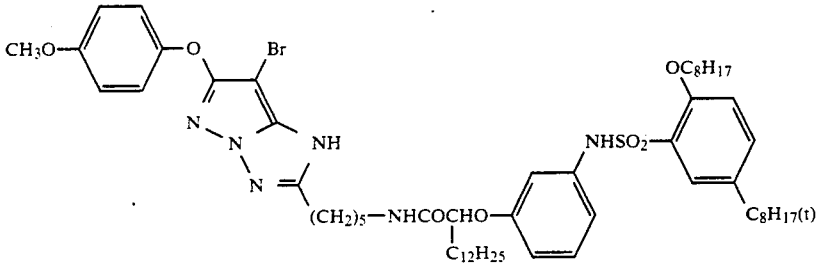
(12)
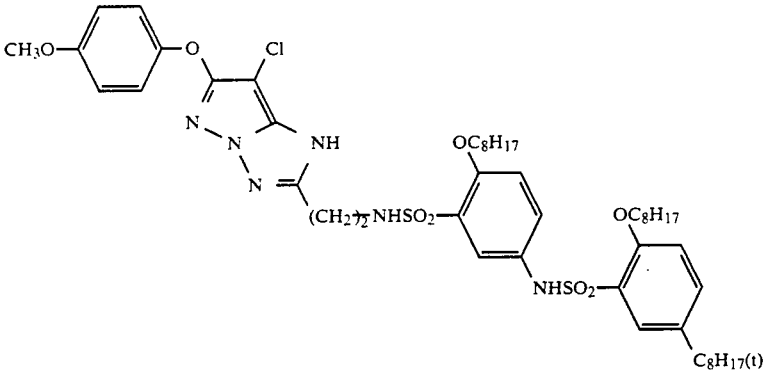
(13)
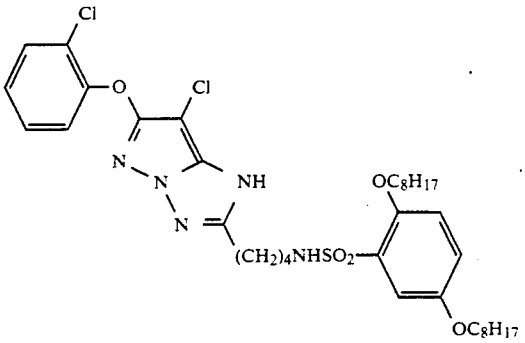

-continued
(14)
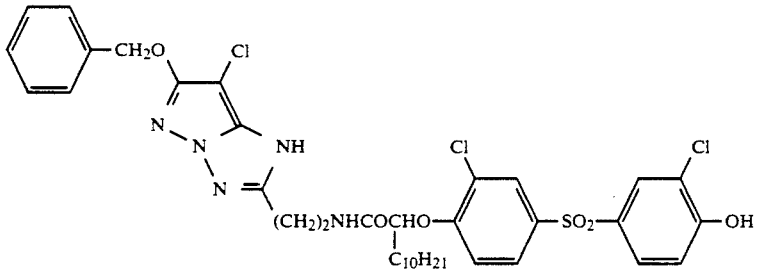
(15)
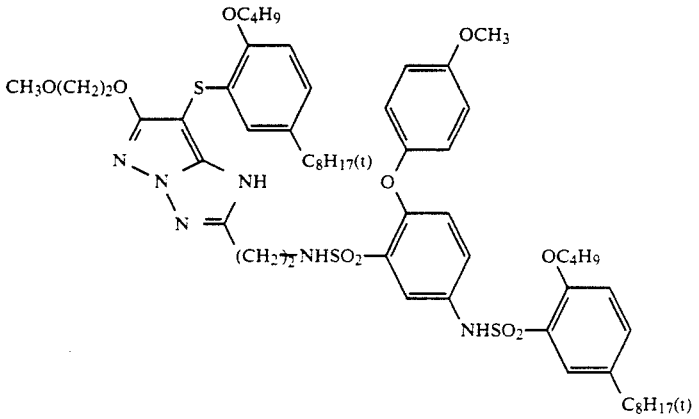
(16)
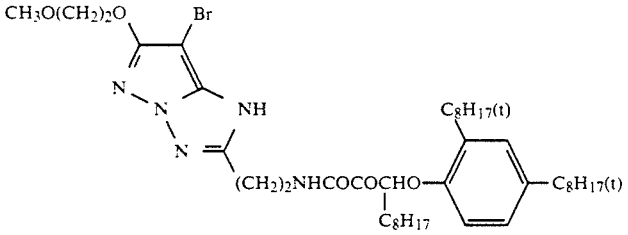
(17)
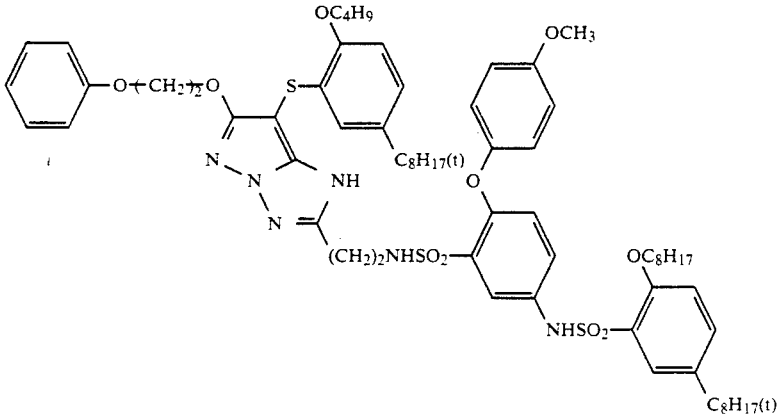

-continued
(18)
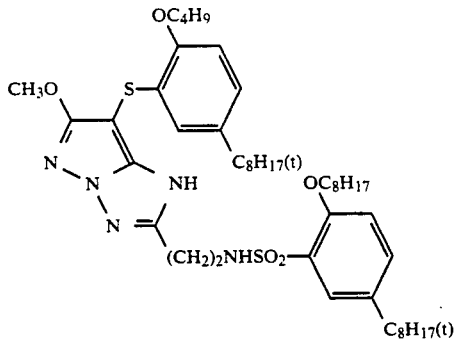
(19)
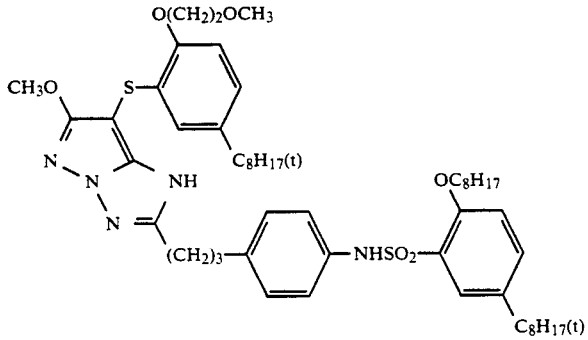
(20)
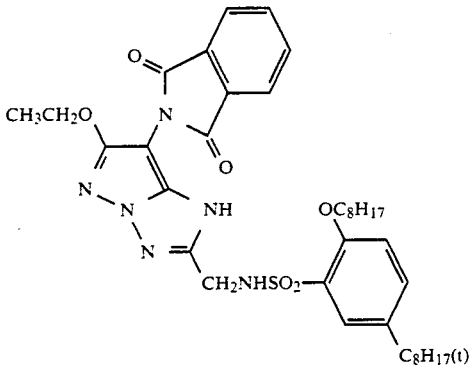
(21)
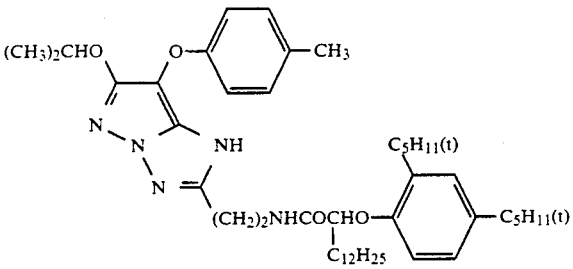
(22)
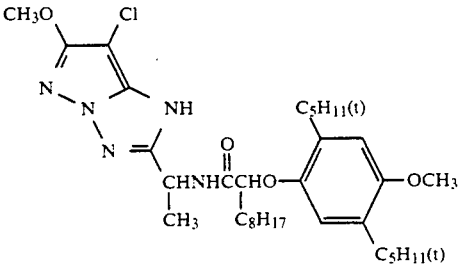

-continued
(23)
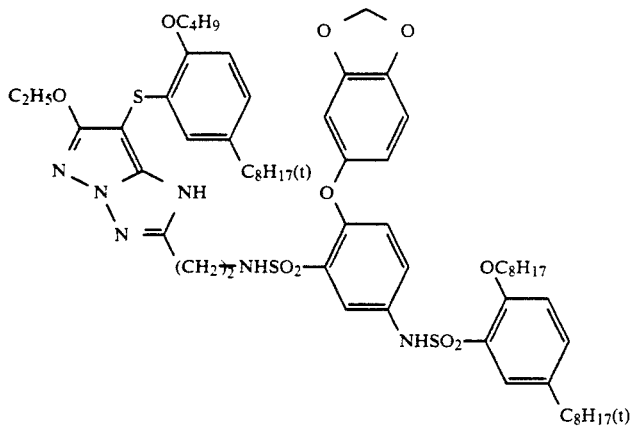
(24)
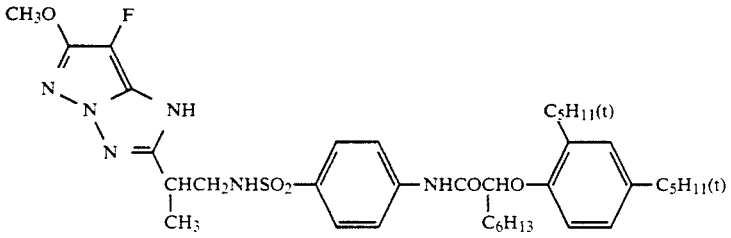
(25)
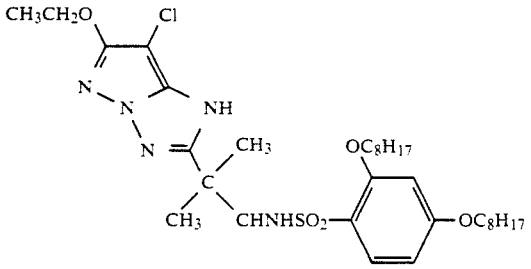
(26)
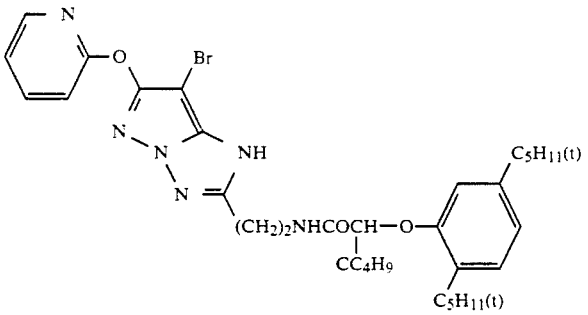
(27)
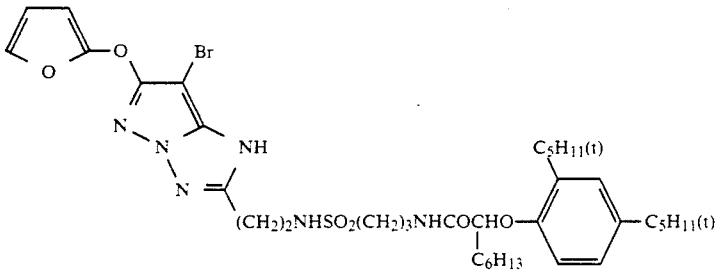

-continued
(28)
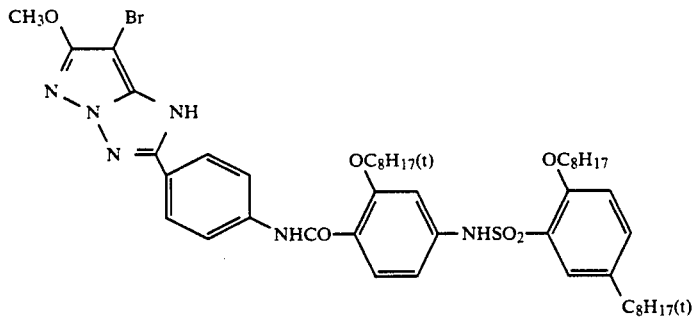
(29)
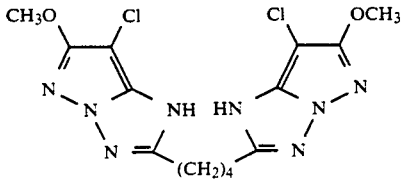
(30)
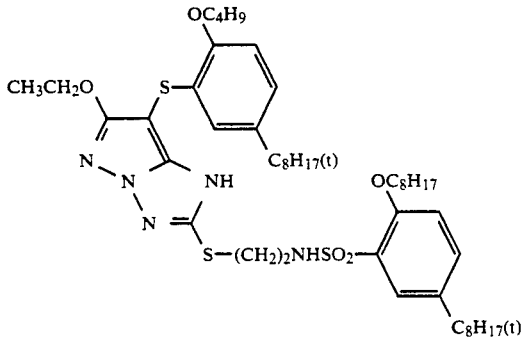
(31)
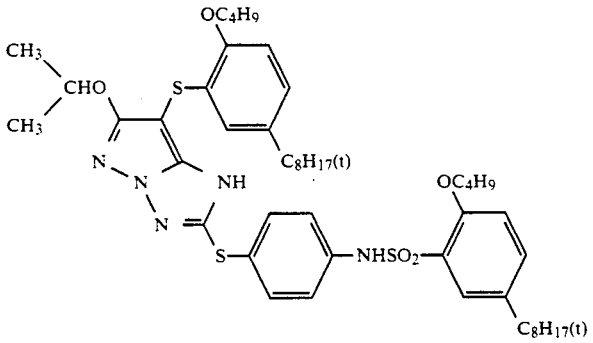
(32)
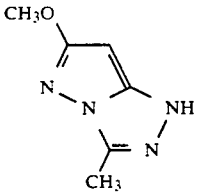
(33)
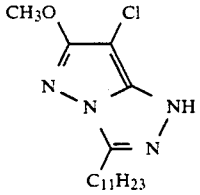
(34)
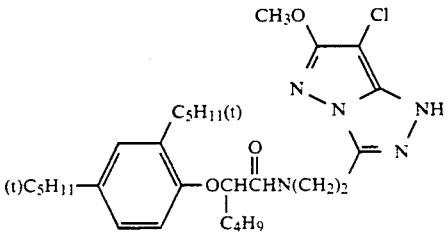
(35)
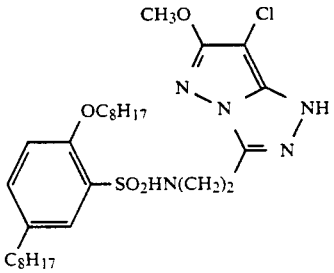

-continued
(36)
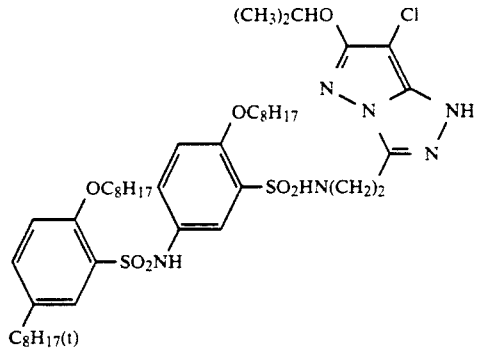
(37)
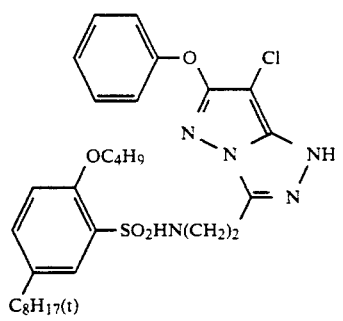
(38)
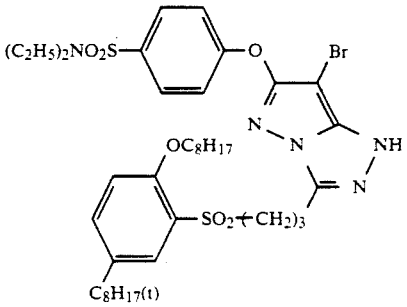
(39)
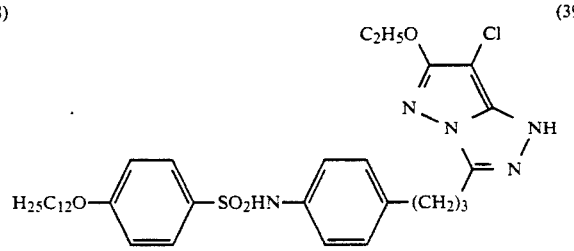
(40)
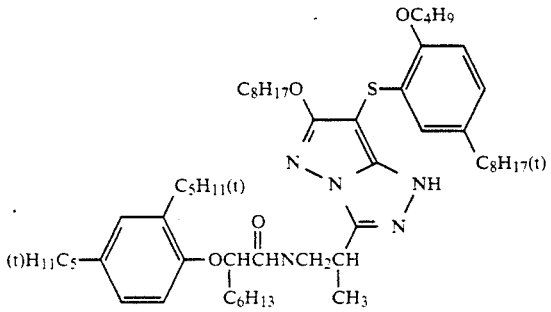
(41)
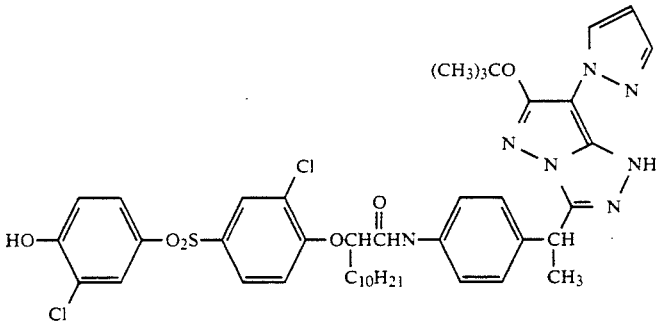
(42)
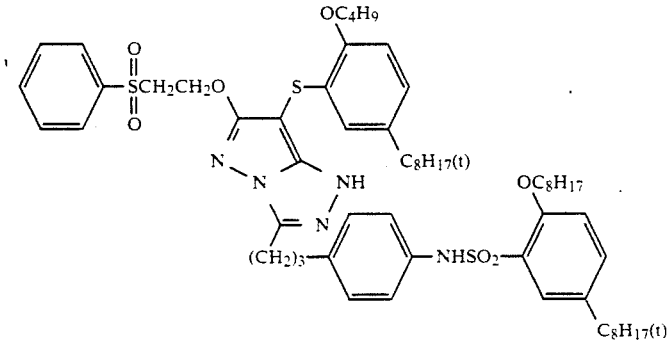

-continued
(43)
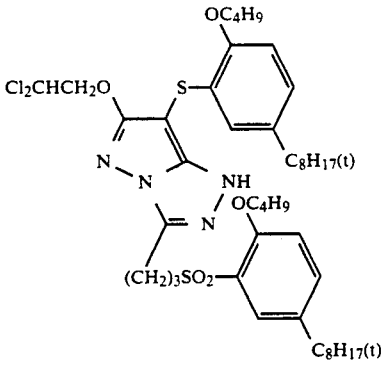
(44)
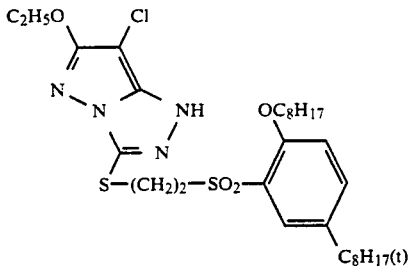
(45)
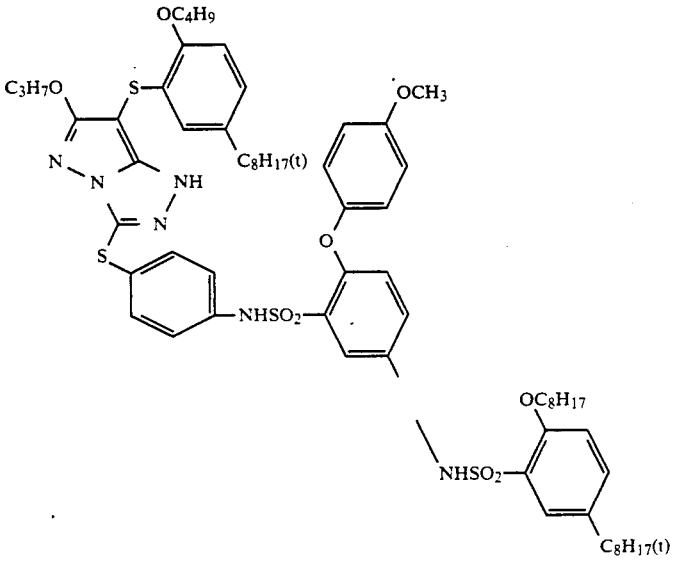
(46)
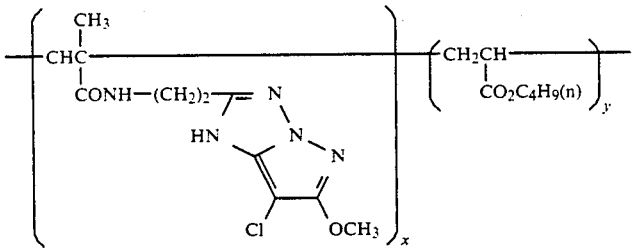
x:y = 50:50
(Weight Ratio)
Molecular Weight: about 30,000
(47)
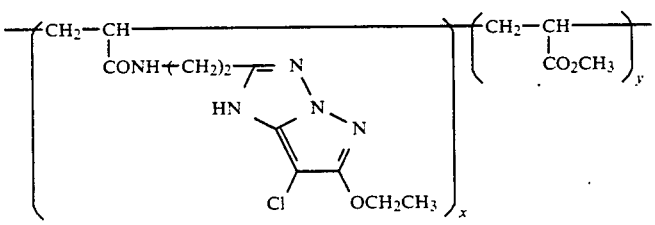
x:y = 45:55
(Weight Ratio)
Molecular Weight: about 30,000

-continued
(48)
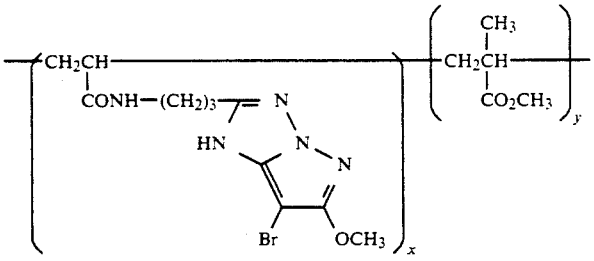
x:y = 45:55
(Weight Ratio)
Molecular Weight: about 30,000
(49)
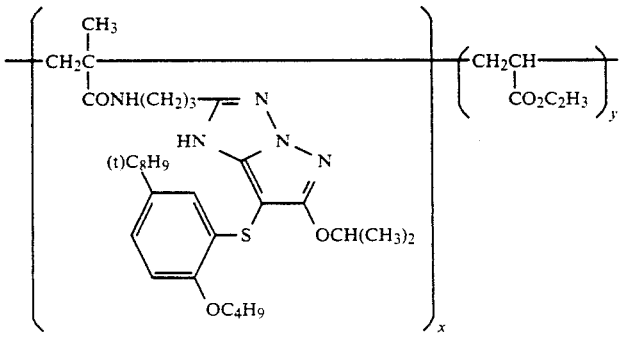
x:y = 50:50
(Weight Ratio)
Molecular Weight: about 30,000
(50)
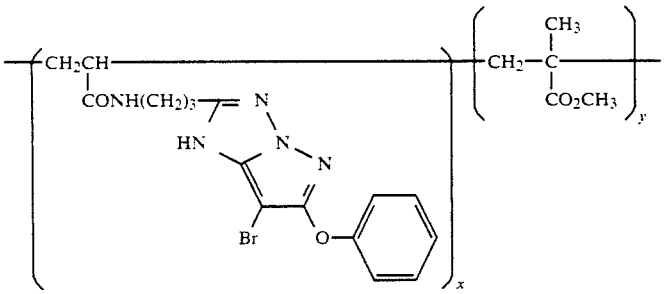
x:y = 45:55
(Weight Ratio)
Molecular Weight: about 30,000
(51)
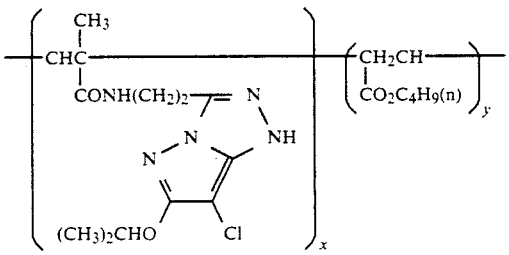
x:y = 50:50
(Weight Ratio)
Molecular Weight: about 30,000

-continued
(52)
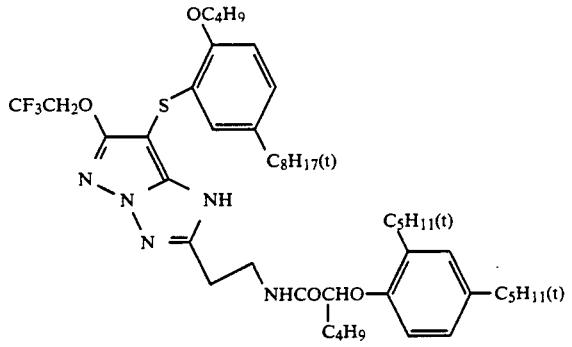
(53)
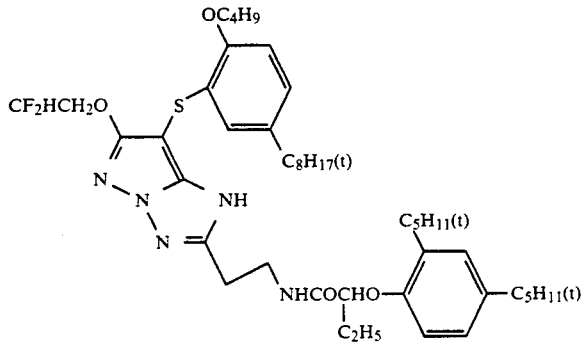
(54)
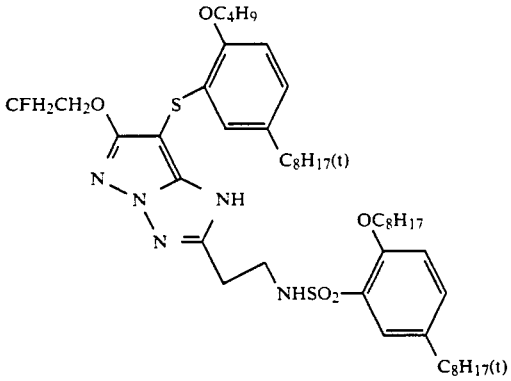
(55)
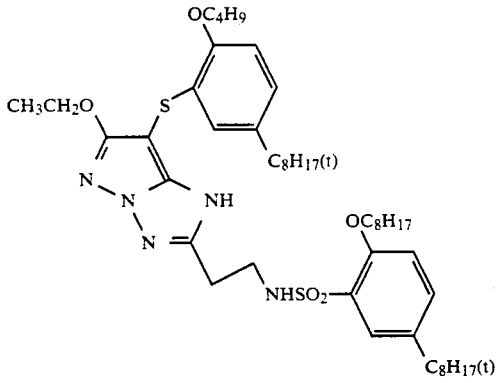
(56)
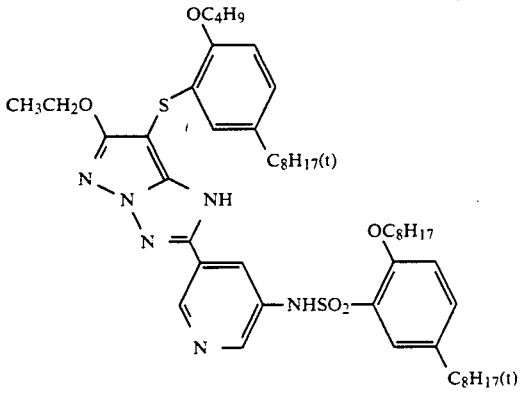
(57)
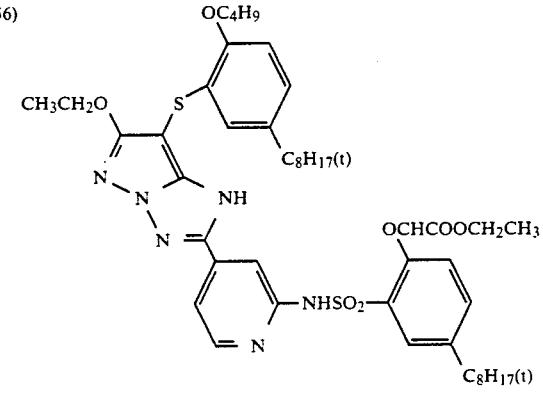

-continued (58)

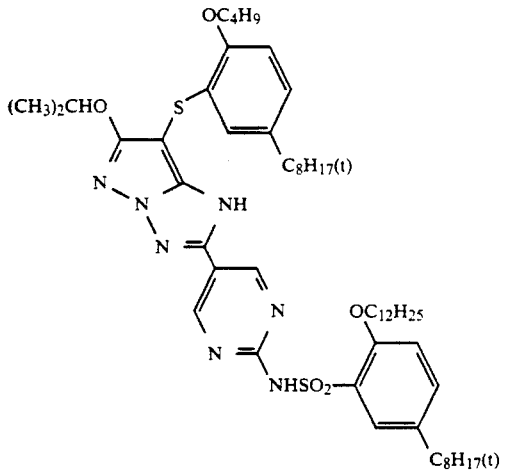

(59)

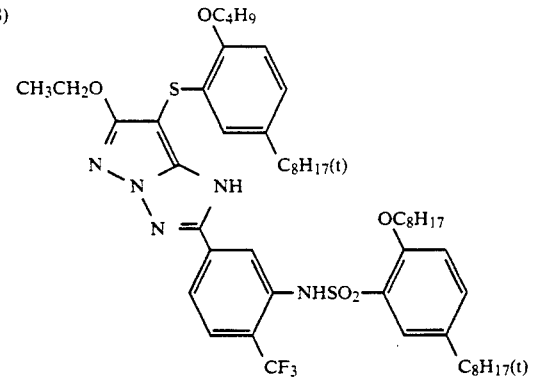

(60)

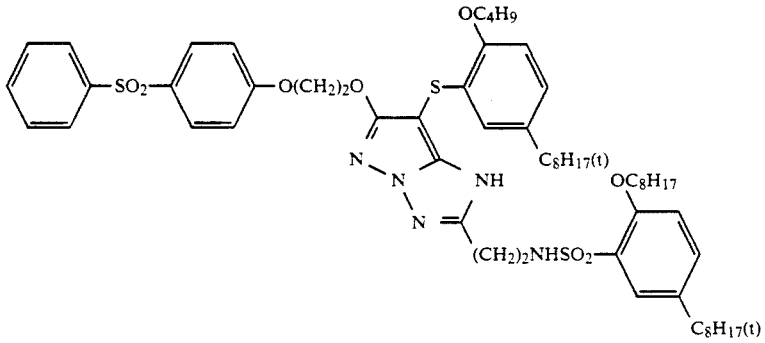

The sensitizing dyes represented by the formulae (A), (B) and (C) are described in detail below.

$W_1$ and $W_2$ each represents a hydrogen atom or an alkyl group (a group which has from 1 to 6 carbon atoms, for example, methyl, ethyl, propyl, butyl).

$W_1$ is preferably an ethyl group or a propyl group and $W_2$ is preferably a hydrogen atom.

$V_1$, $V_2$, $V_3$ and $V_4$ each represents a hydrogen atom, halogen atoms (for example, chlorine, bromine ), alkyl groups (which have from 1 to 8 carbon atoms, for example, methyl, ethyl, propyl, butyl), aryl groups (for example, phenyl), alkoxy groups (which have from 1 to 8 carbon atoms, for example, methoxy, ethoxy, propoxy), amido groups (which have from 2 to 8 carbon atoms, for example, acetamido, propionamido, benzamido), alkoxycarbonyl groups (which have from 2 to 8 carbon atoms, for example, methoxycarbonyl, ethoxycarbonyl) or cyano groups, which may be substituted or unsubstituted. Furthermore, $V_1$ and V2, and $V_3$ and V4, may be the same or different and they may represent condensed benzene rings.

$V_5$ and $V_6$ may be the same or different and each represents any of the aforementioned groups described for V1, V2, $V_3$ and $V_4$ except for the aryl groups and condensed benzene rings.

The subscripts o, p, q, r, s and t each represents an integer of from 1 to 4 and when the subscripts each represents an integer of from 2 to 4, $V_1$'s, $V_2$'s, $V_3$'s, or V4's may be the same or different.

The preferred groups for $V_1$to $V_6$ are described below.

When Y is an oxygen atom, each $V_1$ is preferably a phenyl group or a condensed benzene ring, and $V_2$ is preferably a phenyl group, condensed benzene ring, chlorine atom or alkoxy group.

When Y represents a sulfur atom, each $V_2$ is preferably a hydrogen atom, halogen atom, alkyl group, phenyl group, alkoxy group or amido group.

Each of $V_3$ and $V_5$ preferably represent phenyl groups or chlorine atoms, and in some cases condensed benzene rings, and each of $V_4$ and $V_6$ are preferably trifluoromethyl groups, chlorine atoms, alkoxycarbonyl groups or cyano groups. Furthermore, in formula (C) there is preferably either one chlorine atom substituted in each of the two benzotriazolyl groups or two chlorine atoms substituted in one of these groups.

$R_{21}$, $R_{22}$, $R_{23}$, $R_{24}$, $R_{25}$, $R_{26}$, $R_{27}$, $R_{28}$ and $R_{29}$ represent substituted or unsubstituted alkyl groups (with not more than 8 carbon atoms, for example, methyl, ethyl, propyl, butyl, which may be branched or cyclic, for example, isopropyl, cyclohexyl groups), or substituted or unsubstituted aralkyl groups (for example, benzyl, phenethyl). The alkyl groups which have from 1 to 5 carbon atoms and the aralkyl groups which have from 7 to 10 carbon atoms are preferred.

There are two or more of these groups in all of formulae (A), (B) and (C), but at least one of the groups present in the same molecule represents an alkyl group or an aralkyl group which contains a sulfo group or a carboxyl group or a salt thereof, or which contains a hydroxyl group.

X1, $X_2$ and $X_3$ represent acid anions (for example, a chloride ion, bromide ion, iodide ion, p-toluenesulfonate ion, perchlorate ion, etc.).

Moreover, l, m and n represent 0 or 1, and they represent 0 in cases in which the compound is an intramolecular salt.

The sensitizing dyes represented by the formulae (A), (B) and (C) used in the present invention are well known compounds and they can be synthesized easily with reference to the methods described by F. M. Hamer in "Heterocyclic Compounds—Cyanine Dyes and Related Compounds", Chapter 5, pages 116–147, published by John Wiley and Sons, 1964), by D. M. Sturmer in "Heterocyclic Compounds—Special Topics in Heterocyclic Chemistry", Chapter 8, Section 5, pages 482–515, published by John Wiley and Sons, 1977 and the methods disclosed in Japanese Patent Publication Nos. 13823/68, 16589/69, 9966/73 and 4936/68 and Japanese Patent Application (OPI) No. 82416/77, etc.

Actual examples of sensitizing dyes which can be represented by the formulae (A), (B) and (C) which are used in the present invention are shown below, but the present invention is not limited to these examples.

(A-1)

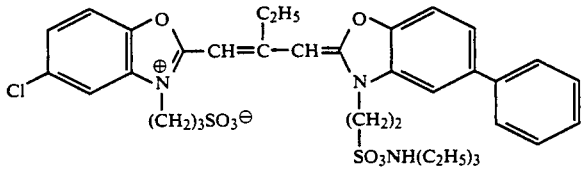

(A-2)

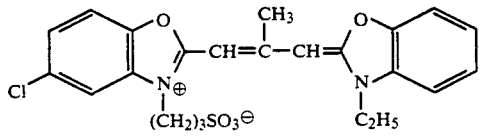

(A-3)

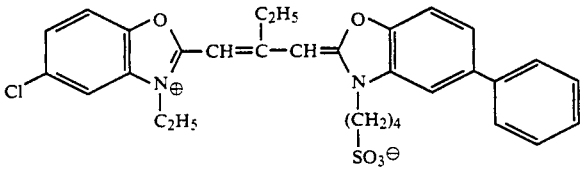

(A-4)

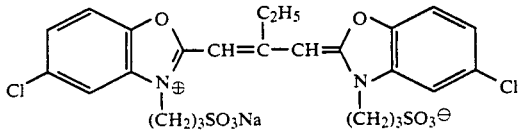

(A-5)

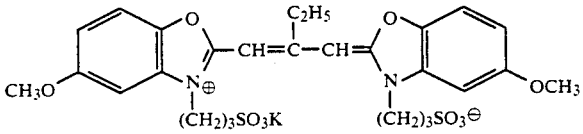

(A-6)

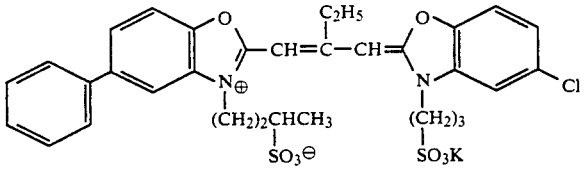

(A-7)

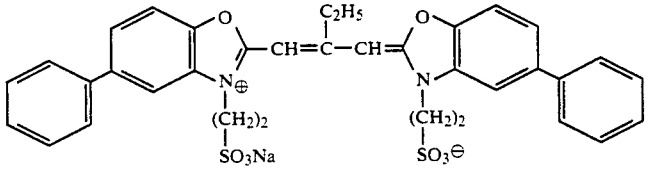

(A-8)

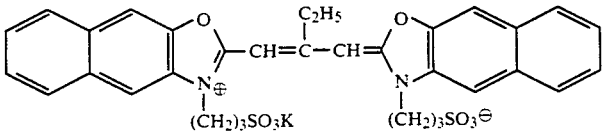

-continued
(A-9)
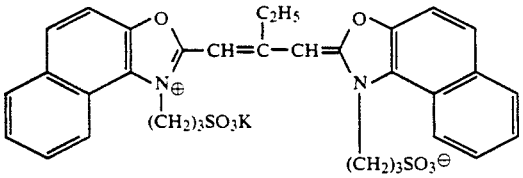
(A-10)
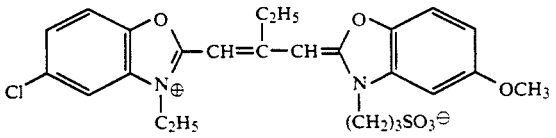
(A-11)
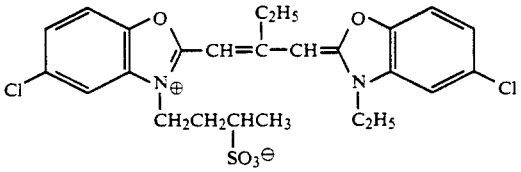
(A-12)
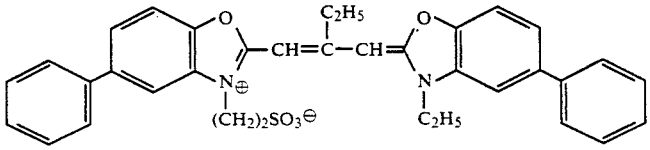
(A-13)
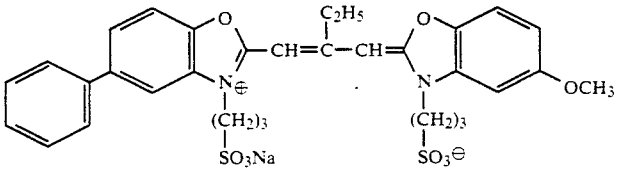
(A-14)
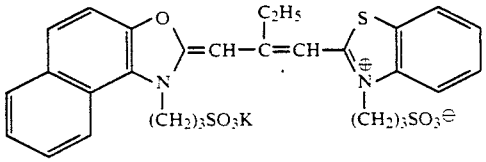
(A-15)
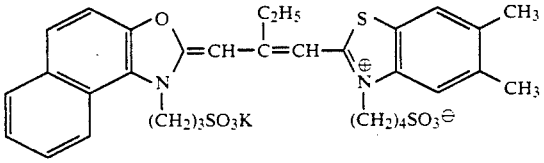
(A-16)
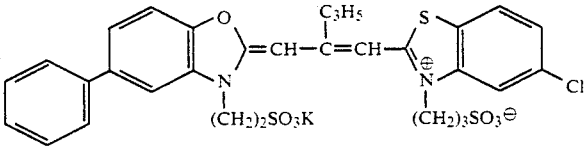
(A-17)
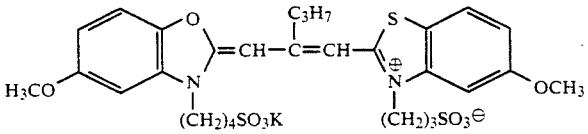
(A-18)
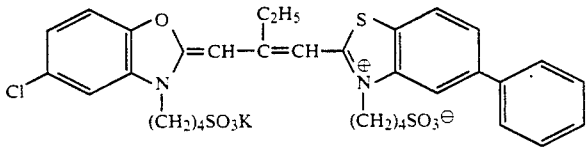
(A-19)
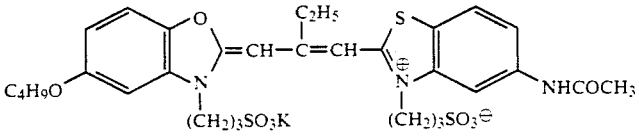

-continued
(A-20)
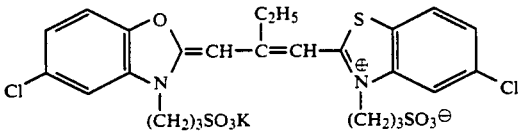
(A-21)
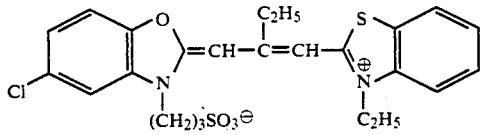
(A-22)
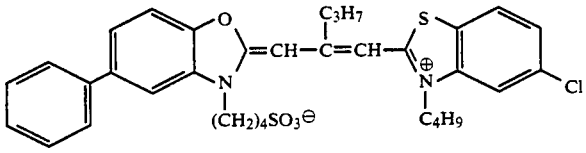
(A-23)
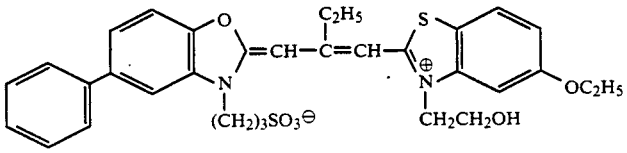
(B-1)
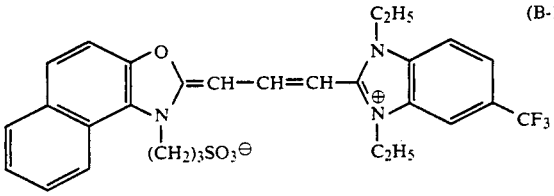
(B-2)
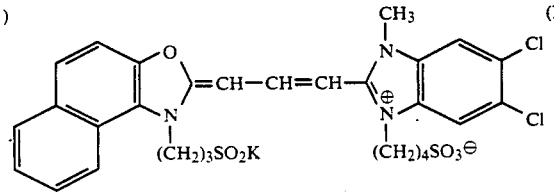
(B-3)
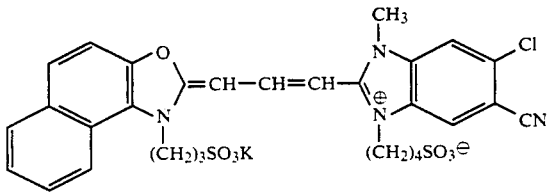
(B-4)
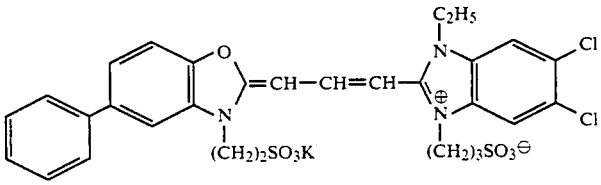
(B-5)
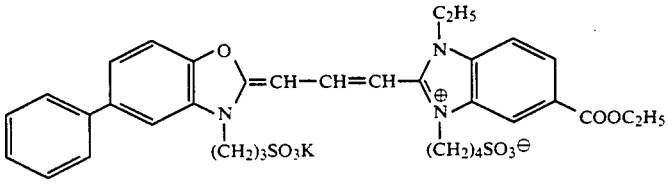
(B-6)
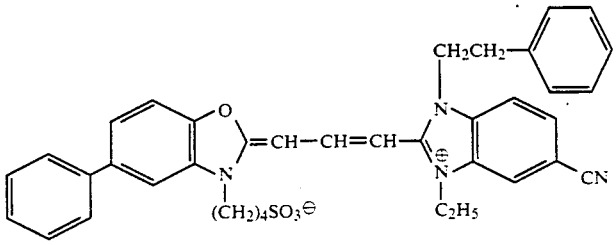

-continued
(B-7)
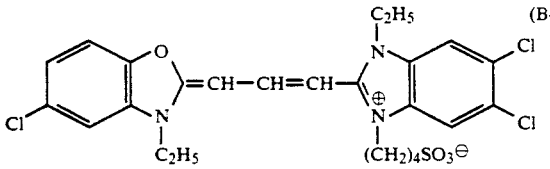
(B-8)
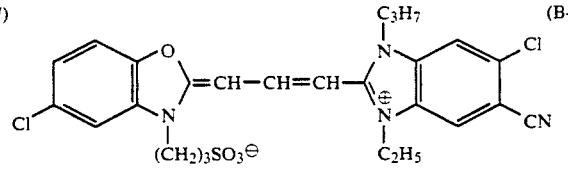
(B-9)
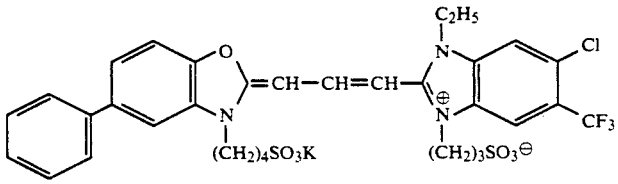
(C-1)
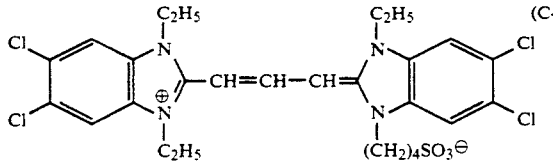
(C-2)
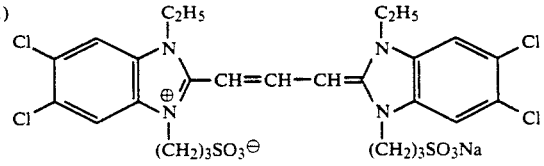
(C-3)
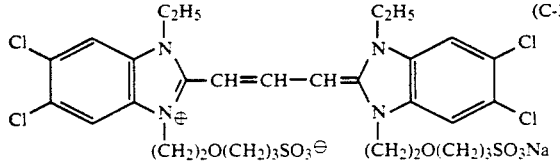
(C-4)
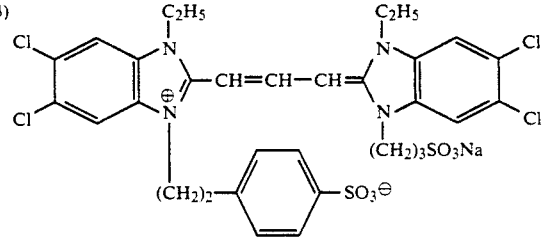
(C-5)
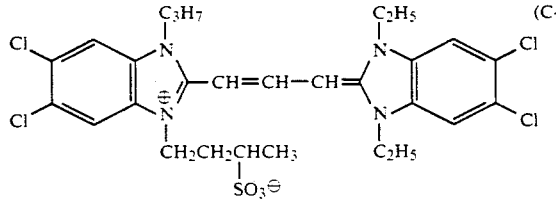
(C-6)
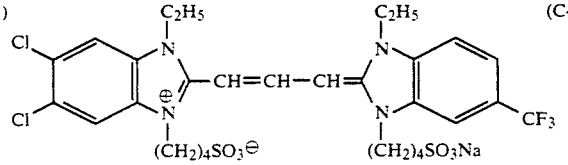
(C-7)
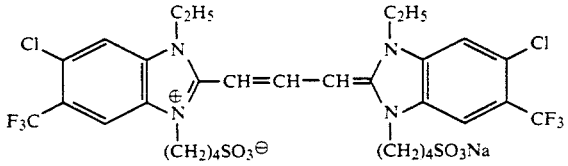
(C-8)
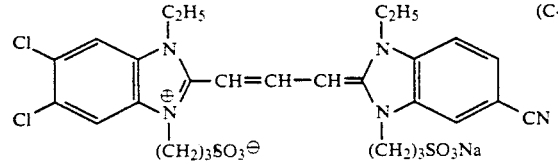
(C-9)
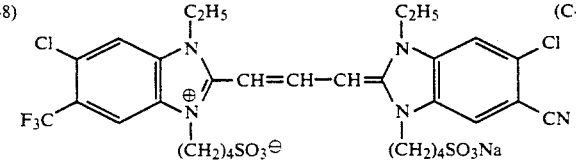
(C-10)
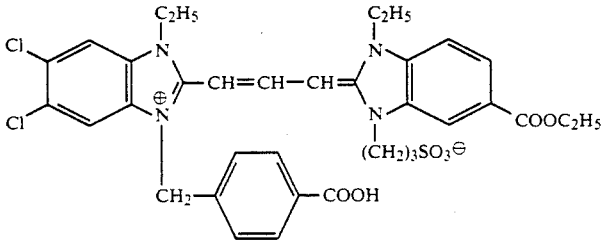

-continued

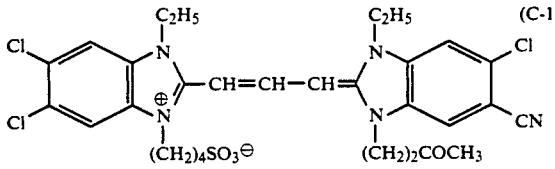

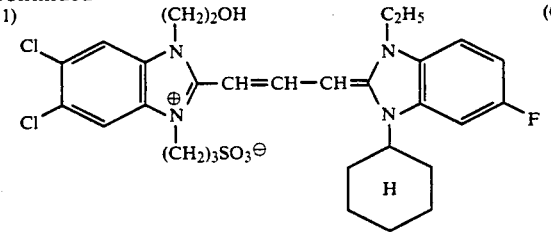

The sensitizing dyes represented by the formulae (A), (B) and (C) which are used in the present invention are included in the silver halide emulsion layer at a rate of from $1\times10^{-6}$ mol to $5\times10^{-3}$ mol, preferably at a rate of from $1\times10^{-5}$ mol to $2.5\times10^{-3}$ tool, and most desirably at a rate of from $4\times10^{-5}$ tool to $1\times10^{-3}$ tool, per tool of silver halide in the silver halide emulsion layer.

Two or more of the sensitizing dyes represented by the formulae (A), (B) and (C) may be included in the same silver halide emulsion layer and the same sensitizing dye may be used in different silver halide emulsion layers.

The sensitizing dyes used in the present invention can be dispersed directly in the emulsion. Furthermore, they may be dissolved in suitable solvent, for example, methyl alcohol, ethyl alcohol, n-propanol, methylcellosolve, acetone, water, pyridine or mixtures of these solvents prior to addition to the emulsion in the form of a solution. Furthermore, ultrasonics can be used to achieve dissolution. Furthermore, methods in which the dye is dissolved in a volatile organic solvent which is then dispersed in a hydrophilic colloid and the resulting dispersion is added to the emulsion, as disclosed in the specification of U.S. Pat. No. 3,469,987, the method in which a water insoluble dye dispersed without dissolving in a water soluble solvent and the resulting dispersion is added to the emulsion, as disclosed in Japanese Patent Publication No. 24185/71, the method in which the dye is dissolved in a surfactant and resulting solution is added to the emulsion, as disclosed in the specification of U.S. Pat. No. 3,822,135, the method in which a solution is obtained using a red shifted compound and the resulting solution is added to the emulsion, as disclosed in Japanese Patent Application No. 74624/76, and the method in which the dye is dissolved in an acid which is essentially water free and the solution is added to the emulsion, as disclosed in Japanese Patent Application (OPI) No. 80826/75, etc., can be used as methods for the addition of the sensitizing dyes. Moreover, the methods disclosed in U.S. Pat. Nos. 2,912,343, 3,342,605, 2,996,287 and 3,429,835, etc., can also be used for addition to an emulsion. Furthermore, the above mentioned sensitizing dyes may be dispersed uniformly in the silver halide emulsion prior to coating on a suitable support, but of course they can also be dispersed in any process during the preparation of the silver halide emulsion.

The speed at the spectral sensitivity peak wavelength between 540 nm and 555 nm is preferably twice or more of the speed at 500 nm of the green sensitive layer under equal energy exposure conditions. More desirably, the former speed is 2.5 times or more of the latter speed, and most desirably, the former speed is thrice or more of the latter speed.

There are various methods by which this spectral speed distribution can be achieved, and a number of methods are normally used simultaneously. In practice these involve the types and amounts of sensitizing dyes used, the methods used for their addition, the conjoint use of additives which alter the adsorption state of the dyes, and the utilization of optical filtering effects with a silver halide grain crystal phase or water soluble dyes.

The light fastness of the magenta color images formed from the magenta couplers which are used in this invention is improved by the conjoint use of color image stabilizers which can be represented by the general formula indicated below.

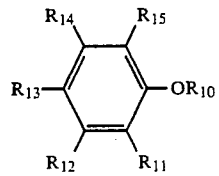

General Formula

Here $R_{10}$ represents a hydrogen atom, an alkyl group, an aryl group or a heterocyclic group, $R_{11}$, $R_{12}$, $R_{14}$ and $R_{15}$ each represents a hydrogen atom, a hydroxyl group, an alkyl group, an aryl group, an alkoxy group, an acylamino group, an alkoxycarbonyl group, or a sulfonamido group, and $R_{13}$ represents an alkyl group, a hydroxyl group, an aryl group or an alkoxy group. Furthermore, $R_{10}$ and $R_{11}$ may undergo ring closure to form a 5- or 6-membered ring. Moreover, $R_{10}$ and $R_{11}$ may undergo ring closure to form a methylenedioxy ring. Moreover, $R_{13}$ and $R_{14}$ may undergo ring closure to form a 5-membered hydrocarbon ring.

These compounds also include the compounds which have been disclosed in the specifications of U.S. Pat. Nos. 3,935,016, 3,982,944 and 4,254,216, the specifications of Japanese Patent Application (OPI) Nos. 21004/80 and 145530/79, the specifications of British Patent (Laid Open) Nos. 2,077,455 and 2,062,888, the specifications of U.S. Pat. Nos. 3,764,337, 3,432,300, 3,574,627 and 3,573,050, the specifications of Japanese Patent Application (OPI) Nos. 152225/77, 20327/78, 17729/78 and 6321/80, the specifications of British Patent 1,347,556 and British Patent (Laid Open) No. 2,066,975, the specifications of Japanese Patent Publication Nos. 12337/79 and 31625/73, the specifications of U.S. Pat. No. 3,700,455, and the specifications of Japanese Patent Application (OPI) No. 90155/86.

Preferred embodiments of the present invention are silver halide color photographic materials which contain couplers of the present invention.

The couplers of the present invention may be added to the photographic material or they may be added to the color development bath. The amount added to a photographic material is from $2\times10^{-3}$ tool to $5\times10^{-1}$mol, and preferably from $1\times10^{-2}$ mol to $5\times10^{-1}$ mol, per mol of silver halide, but in the case of a polymeric coupler the amount added may be adjusted so that the color forming part is introduced in an amount as indicated above. When used in a color development bath they are added at a rate of from 0.001 mol to 0.1 mol, and preferably at a rate of from 0.01 mol to 0.05 mol, per 1000 ml of bath.

The pyrazoloazole based couplers of this invention can be introduced into photographic materials using a variety of well known methods of dispersion of which typical examples include the solid dispersion method, the alkali dispersion method, preferably the latex dispersion method and, most desirably, the oil in water dispersion method. In the oil in water dispersion method the coupler is dissolved in a high boiling point organic solvent of boiling point at least 175° C. and/or a low boiling point solvent known as an auxiliary solvent and then the solution is finely dispersed in water or an aqueous medium such as an aqueous gelatin solution in the presence of a surfactant. Examples of high boiling point organic solvents have been disclosed in U.S. Pat. No. 2,322,027, etc. Phase reversal can be used for dispersion, and the dispersion may be used for coating after the removal or partial removal, as required, of the auxiliary solvent by means of distillation, noodle washing or ultrafiltration, etc.

Actual examples of high boiling point solvents include phthalate esters (such as dibutyl phthalate, dicyclohexyl phthalate, di-2-ethylhexyl phthalate, decyl phthalate, etc.), phosphates or phosphonate esters (such as triphenyl phosphate, tricresyl phosphate, 2-ethylhexyldiphenyl phosphate, tricyclohexyl phosphate, tri-2-ethylhexylphosphate, tridodecyl phosphate, tributoxyethyl phosphate, trichloropropyl phosphate, di-2-ethylhexylphenyl phosphonate, etc.), benzoate esters (such as 2-ethylhexyl benzoate, dodecyl benzoate, 2-ethylhexyl p-hydroxybenzoate, etc.), amides (such as diethyldodecanamide, N-tetradecylpyrrolidone, etc.), alcohols or phenols (such as iso-stearyl alcohol, 2,4-di-t-amylphenol, etc.), aliphatic carboxylic acid esters (such as dioctyl azelate, glycerol tributyrate, isostearyl lactate, trioctyl citrate, etc.), aniline derivatives (such as N,N-dibutyl-2-butoxy-5-t-octylaniline, etc.) and hydrocarbons (such as paraffins, dodecylbenzene, di-isopropylnaphthalene, etc.), etc. Furthermore, organic solvents having a boiling point of at least 30° C., and preferably a boiling point of at least 50° C., but not more than about 160° C., can be used as auxiliary solvents, and typical examples of such solvents include ethyl acetate, butyl acetate, ethyl propionate, methyl ethyl ketone, cyclohexanone, 2-ethoxyethylacetate, dimethylformamide, etc.

Actual examples of the process of the latex dispersion method, the effect thereof and the latex for impregnation have been disclosed in U.S. Pat. No. 4,199,363 and West German Patent Application (OLS) Nos. 2,541,274 and 2,541,230, etc.

The silver halide emulsion used in the present invention may be mixed silver halides as well as silver chloride, silver bromide, and typical examples include silver chlorobromides, silver chloroiodobromides and silver iodobromides. The silver halides preferably used in the present invention are silver chloroiodobromides, silver iodochlorides or silver iodobromides which contain not more than 3 mol % of silver bromide, and silver chloride, silver bromide and silver chlorobromides. The interior and surface layers of the silver halide grains may be different phases or the grains may have a multiphase structure such that they have a junction structure, or alternatively the whole grain may consist of a uniform phase. Furthermore, they may be mixtures of these.

The average grain size of the silver halide grains used in the present invention (the term grain size as used herein refers to a grain diameter in the case of grains spherical or approximately spherical in shape, while it refers to the edge length in the case of cubic grains; in both cases, it is represented by the average based on projected areas of the grains) is preferably not more than 2 $\mu$, but greater than 0.1 $\mu$, and an average grain size of not more than 1 $\mu$, but at least 0.15 $\mu$, is most desirable. The grain size distribution may be narrow or wide. The use of so-called mono-dispersed silver halide emulsions in which the grain size distribution is narrow with at least 90%, and preferably at least 95%, of all the grains in terms of the number of grains or weight being within the average grain size $\pm 40\%$ is preferred in the present invention. Furthermore, two or more mono-dispersed silver halide emulsions of different grain sizes can be mixed in the same layer or coated as separate laminated layers in emulsion layers which have essentially the same color sensitivity in order to obtain the gradation required of the photographic material. Moreover, two or more poly-dispersed silver halide emulsions or combinations of mono-dispersed emulsions and poly-dispersed emulsions can be used in the form of mixtures or laminates.

The silver halide grains used in the present invention may have a regular crystalline form such as a cubic, octahedral, dodecahedral, tetradecahedral, etc., form or they may have an irregular crystalline form such as a spherical form, or they may have a complex form consisting of these crystalline forms. Furthermore, they may have a tabular form, and emulsions in which grains of a tabular form of which the value of the length/thickness ratio is at least 5, and preferably at least 8, account for at least 50% of the total projected area of the grains may be used. Emulsions which consist of mixtures of these various crystalline forms can also be used. These various emulsions may be of the surface latent image type, where the latent image is formed principally on the surface, or of the internal latent image type in which the latent image is formed within the grains.

The photographic emulsions which are used in the present invention can be prepared using the methods described in "Chemie et Physique Photographique", by P. Glafkides (published by Paul Montel, 1967), "Photographic Emulsion Chemistry" by G. F. Duffin (published by the Focal Press, 1966), and in "Making and Coating Photographic Emulsions", by Zelikman et al. (published by the Focal Press, 1964), etc. That is to say, they can be prepared using the acidic method, the alkaline method and the ammonia method, etc., and with methods in which the soluble silver salt and the soluble halide are reacted together in a system in which a single jet method, a double jet method, or a combination of these methods is used. Methods in which the grains are formed in the presence of an excess of silver ion (the so-called reverse mixing method) can also be used. The method in which the pAg of the liquid phases in which the silver halide is being formed is held constant, which is to say the so-called controlled double jet method, can be used as one form of the double jet method. Silver halide emulsions in which the crystalline form is regular and the grain size is almost uniform can be obtained using this method.

Cadmium salts, zinc salts, lead salts, thallium salts, iridium salts or complex salts thereof, rhodium salts or complex salts thereof, and iron salts or complex salts thereof, etc., may be present during the formation or physical ripening of the silver halide grains.

Normally, the emulsions of the present invention are physically ripened, chemically ripened and spectrally sensitized for use. The additives used in such processes have been disclosed in *Research Disclosure*, Vol. 176, No. 17643 (December, 1978) and *Research Disclosure*, Vol. 187, No. 18716 (November, 1979), and the locations of the said disclosures are indicated in the table below.

Known additives for photographic purposes which can be used in the present invention have also been disclosed in the two *Research Disclosures* mentioned above and the locations of these disclosures are indicated in the following table.

| Type of Additive | Research Disclosure No. 17643 | Research Disclosure No. 18716 |
|---|---|---|
| 1. Chemical Sensitizers | Page 23 | Page 648, right column |
| 2. Speed increasing agents | | As above |
| 3. Spectral Sensitizers, Supersensitizers | Pages 23 to 24 | Page 648, right column to page 649, right column |
| 4. Whiteners | Page 23 | |
| 5. Anti-foggants and Stabilizers | Pages 24 to 25 | Page 649, right column |
| 6. Light absorbers, filter dyes, UV Absorbers | Pages 25 to 26 | Page 649, right column to page 650, left column |
| 7. Anti-staining agents | Page 25 right column | Page 650, left column to right column |
| 8. Dye image stabilizers | Page 25 | |
| 9. Film hardening agents | Page 26 | Page 651, left column |
| 10. Binders | Page 26 | As above |
| 11. Plasticizers, lubricants | Page 27 | Page 650, right column |
| 12. Coating promotors, Surfactants | Pages 26 to 27 | As above |
| 13. Anti-static agents | Page 27 | As above |

Various color couplers can be used in the present invention and actual examples are disclosed in the patent disclosed in the aforementioned *Research Disclosure* (RD) No. 17643, VII-C to G. The couplers which form the three primary colors of the subtractive method (which is to say yellow, magenta and cyan) on color development are important as dye forming couplers, and as well as the actual examples of non-diffusible four equivalent or two equivalent couplers disclosed in the patents disclosed in sections VII-C and D of the aforementioned *Research Disclosure* (PAD)No. 17643 the use of those indicated below is preferred in the present invention.

Hydrophobic acylacetamide based couplers, having ballast groups, are typical of the yellow couplers which can be used in the present invention. Actual examples have been disclosed in U.S. Pat. Nos. 2,407,210, 2,875,057 and 3,265,506, etc. The use of two-equivalent yellow couplers is preferred in the present invention and typical examples include yellow couplers having oxygen-atom-linked coupling off group disclosed in U.S. Pat. Nos. 3,408,194, 3,447,928, 3,933,501 and 4,022,620, etc., and yellow couplers having nitrogen-atom-linked coupling off group disclosed in Japanese Patent Publication No. 10739/83, U.S. Pat. Nos. 4,401,752 and 4,326,024, *Research Disclosure*, vol. 180, No. 18053 (April, 1979) , British Patent 1,425,020 and West German Patent Application (OLS) Nos. 2,219,917, 2,261,361, 2,329,587 and 2,433,812, etc. The α-pivaloylacetanilide based couplers provide color dyes of excellent fastness, especially light fastness, while the α-benzoylacetanilide based couplers provide high color densities.

The hydrophobic indazolone based or cyanoacetyl based, and preferably the 5-pyrazolone based couplers, having ballast groups, can be used as magenta couplers which are used conjointly with pyrazoloazole based couplers in the present invention. The 5-pyrazolone based couplers substituted in the 3-position with an arylamino group or an acylamino group are preferred from the point of view of the hue of the dye which is formed and the color density, and typical examples have been disclosed in U.S. Pat. Nos. 2,311,082, 2,343,703, 2,600,788, 2,908,573, 3,062,653, 3,152,896 and 3,936,015, etc. The nitrogen-atom-linked coupling off groups disclosed in U.S. Pat. No. 4,310,619 and the arylthio groups disclosed in U.S. Pat. No. 4,351,897 are especially desirable as the coupling off groups of the two equivalent 5-pyrazolone based couplers. Furthermore, high color densities can be obtained with the 5-pyrazolone based couplers which have ballast groups disclosed in European Patent 73,636.

Hydrophobic, non-diffusible naphthol based and phenol based cyan couplers can be used in the present invention and naphthol based couplers disclosed in U.S. Pat. No. 2,474,293, and two-equivalent naphthol based couplers having oxygen-atom-linked coupling off groups disclosed in U.S. Pat. Nos. 4,052,212, 4,146,396, 4,228,233 and 4,296,200 are preferred examples of these couplers. Furthermore, actual examples of phenol based couplers have been disclosed in U.S. Pat. Nos. 2,369,929, 2,801,171, 2,772,162 and 2,895,826, etc.

The use of cyan couplers which are fast to humidity and temperature is preferred in the present invention, and typical examples of these include the phenol based cyan couplers which have an alkyl group consisting of an ethyl or larger group in the meta-position of the phenol ring disclosed in U.S. Pat. No. 3,772,002, the 2,5-diacylamino substituted phenol based couplers disclosed in U.S. Pat. Nos. 2,772,162, 3,758,308, 4,126,396, 4,334,011 and 4,327,173, West German Patent Application (OLS) No. 3,329,729 and European Patent 121,365, etc., and the phenol based couplers which have phenylureido group in the 2-position and an acylamino group in the 5-position disclosed in U.S. Pat. Nos. 3,446,622, 4,333,999, 4,451,559 and 4,427,767, etc.

Couplers of which the color dyes have appropriate diffusion properties can be used conjointly to improve graininess. Actual examples of magenta couplers of this type have been disclosed in U.S. Pat. No. 4,366,237 and British Patent 2,125,570, and actual examples of yellow, magenta and cyan couplers of this type have been disclosed in European Patent 96,570 and West German Patent Application (OLS) No. 3,234,533.

The dye forming couplers and special couplers mentioned above may have a polymeric form and consist of at least dimers. Typical examples of polymerized dye forming couplers have been disclosed in U.S. Pat. Nos. 3,451,820 and 4,080,211. Actual examples of polymerized magenta couplers have been disclosed in British Patent 2,102,173 and U.S. Pat. No. 4,367,282.

Couplers which release photographically useful residual groups on coupling can also be used preferentially in the present invention. DIR couplers which release development inhibitors as disclosed in the patents disclosed in section VII-F of the aforementioned *Research Disclosure,* Vol. 176, No. 17643 are useful in this respect.

As a support which can be used in the silver halide color photographic materials according to the present invention, a based paper made from natural pulp, synthetic pulp or the mixture thereof, a polyester film such as a polyethylene terephthalate film, a polybutylene terephthalate, etc., a cellulose triacetate film, a polystyrene film, a polypropylene film, a plastic film such as a polyolefin film, etc., a vinyl chloride resin, etc. can be used.

In the present invention, the use of a reflective support is preferred. The reflective support preferably comprises on a base made of the above-described material having coated thereon a water-resistant resin layer, made of, for example, polyethylene, which resin layer contains as a light reflective substance titanium oxide, zinc oxide, calcium carbonate, calcium sulfate, etc. AS the another embodiment, the reflective support obtained by kneading the vinyl chloride resin and the above-described light reflective substance and then molding the kneaded product can also be used.

The color photographic materials of the present invention can be developed in accordance with the usual methods disclosed on pages 28–29 of *Research Disclosure,* Vol. 176, No. 17643 and from the left hand column to the right hand column of page 651 of *Research Disclosure,* Vol. 187, No. 18716.

The color photographic materials of the present invention can be subjected to an ordinary water washing process or to a stabilization process after the development, bleach-fixing or fixing processes have been carried out.

The water washing process is usually carried out using counter-current washing with two or more tanks to save water. The multi-stage counter-current stabilization process as disclosed in Japanese Patent Application (OPI) No. 8543/82 is a typical stabilization process for replacing a water washing process. A counter-current system with 2 to 9 tanks is required for this process. Various compounds can be added to the stabilization bath with a view to stabilizing the image. For example, various buffers (for example, combinations of borates, metaborates, borax, phosphates, carbonates, potassium hydroxide, sodium hydroxide, aqueous ammonia, mono-carboxylic acids, dicarboxylic acids, polycarboxylic acids, etc.) for adjusting the pH of the film (for example, to pH 3 to 8), and formalin, etc., are typical of these compounds. Furthermore, various additives such as hard water softening agents ( inorganic phosphoric acid, aminopolycarboxylic acids, organic phosphoric acids, amino-polyphosphonic acids, phosphonocarboxylic acids, etc.), sterilizers (benzoisothiazolinone, isothiazolone, 4-thiazolinbenzimidazole, halogenated phenols, etc.), surfactants, brightening agents, film hardening agents, etc., can also be used, and two or more compounds can be used conjointly for the same or different purposes.

Furthermore, the addition of various ammonium salts, such as ammonium chloride, ammonium nitrate, ammonium sulfate, ammonium phosphate, ammonium sulfite, ammonium thiosulfate, etc., as post processing film pH adjusting agents is preferred.

The invention is illustrated below by means of examples, but the present invention should not be construed as limited to these examples. Unless otherwise indicated, all percents, parts, ratios and the like are by weight.

EXAMPLE 1

Two ml of tri-n-octyl phosphate (TOP) and 20 ml of ethyl acetate were added to 10 g of illustrative compound (6) and a solution was formed and emulsified and dispersed in 80 ml of 10% aqueous gelatin solution which contained 10 ml of a 1% aqueous solution of sodium dodecylbenzenesulfonate. This was emulsion (a).

Next, emulsion (b) was prepared in exactly the same way as described above except that 15.2 g of illustrative compound (8) was used in place of illustrative compound (6).

Moreover, emulsion (c) was prepared in the same way as above, except that just 2 ml of TOP was used.

On the other hand, illustrative sensitizing dye (A-1) was added at the rate of $2.5\times10^{-4}$ mol per mol of silver chlorobromide to a silver chlorobromide emulsion (Br 50 mol %, containing 66.0 g of silver per Kg) as a green layer sensitizing dye of this invention, and all of each of the above mentioned emulsions (a), (b) and (c) were added to 135 g of this green sensitive emulsion. These became green sensitive emulsions (A) , (B) and (C) .

Moreover, the same quantity of comparative green sensitive sensitizing dye indicated below was added to the silver chlorobromide emulsion mentioned above and all of each of the emulsions (a), (b) and (c) as described above were added to the same amount of this green sensitive emulsion. These became green sensitive emulsions (D), (E) and (F).

Comparative Green Sensitive Sensitizing Dye

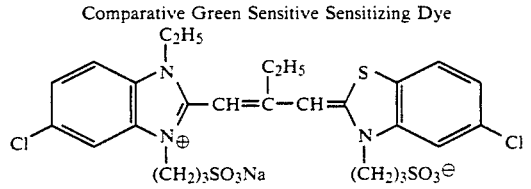

The green sensitive emulsions (A) to (F) were formed into solutions and aged with stirring over a period of 4 hours in a constant temperature vessel at 40° C. Subsequently, 2,4-dichloro-6-hydroxy-s-triazine sodium salt was added as a film hardening agent and the liquids were coated so as to provide a coated silver weight of 500 mg/m$^2$ in each case on cellulose triacetate supports, and Samples I-A to I-F were completed by establishing a gelatin solution which contained the same film hardening agent over the top as a protective layer.

Each film sample was exposed through a continuous wedge using blue light or green light and then they were developed and processed in the way indicated below.

| Development Processing | |
|---|---|
| Black-and-white development | 33° C. 3 minutes |
| Stop | 33° C. 1 minute |
| Fix | 33° C. 7 minutes |
| Water wash | 30° C. 10 minutes |
| Black-and-White Development Bath Composition | |
| Metol | 2 g |
| L-Ascorbic acid | 10 g |
| Potassium bromide | 0.6 g |
| Sodium carbonate (mono-hydrate) | 25 g |
| Water | to make 1000 ml |

-continued

| | |
|---|---|
| Stop Bath Composition | |
| Glacial acetic acid | 10 ml |
| Water | to make 1000 ml |
| Fixing Bath Composition | |
| Ammonium thiosulfate | 60 g |
| Sodium sulfite | 2 g |
| Sodium bisulfite | 10 g |
| Water | to make 1000 ml |

The optical densities for white light were measured with the silver images of the samples obtained on processing and the results obtained were as shown in Table 1.

TABLE 1

| | Magenta Coupler | Speed* Blue Light (Intrinsic region) | Speed* Green Light | Green Sensitive Sensitizing Dye |
|---|---|---|---|---|
| A | (6) | 101 | 100 | This invention |
| B | (8) | 100 | 103 | This invention |
| C | — | 100 | 100 | This invention |
| D | (6) | 101 | 118 | For Comparison |
| E | (8) | 102 | 120 | For Comparison |
| F | — | 101 | 108 | For Comparison |

* Relative value of the exposure for providing a density of fog + 0.2. The value for Sample I-C was taken to be 100.

From the results shown in Table 1, it is clear that when the green sensitive sensitizing dyes of the present invention are used with the pyrazoloazole magenta couplers of the present invention there is virtually no loss of speed either in the intrinsic speed range for blue light or in the green light sensitized region, but with the green sensitive sensitizing dye used for comparative purposes there was a marked loss of speed in green light. It is thought that this is due to desorption of the sensitizing dye during the dissolution process. In this respect it is clear that there is virtually no loss of speed with the green sensitive sensitizing dyes of the present invention. Thus it is clear that the green sensitive sensitizing dye and pyrazoloazole magenta coupler combinations of the present invention are advantageous.

EXAMPLE 2

TOP (4.0 ml) and 20 ml of ethyl acetate were added to 19.9 g of illustrative compound (17) and emulsion (g) was prepared using the same method as in Example 1. Emulsion (h) was prepared in the same way as described above, except that 18.7 g of illustrative compound (23) was used in place of illustrative compound (17) and 3.7 ml of TOP was used.

Next, emulsion (i) was prepared in the same way as above with the addition of 2.9 ml of TOP of 14.6 g of the magenta coupler indicated below. Emulsion (j) was prepared by the emulsification and dispersion of 2.5 ml of TOP alone.

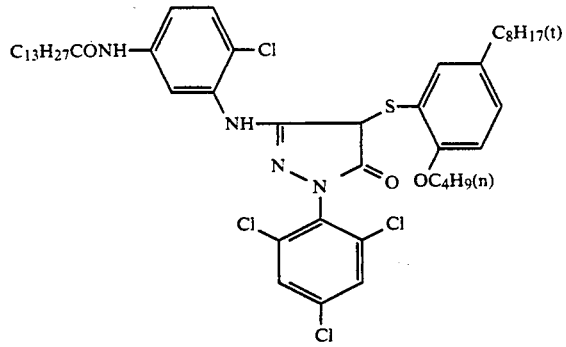

These emulsions were added, using the same quantities as before, to the silver chlorobromide emulsion and the two types of green sensitive sensitizing dyes indicated in Example 1 and , using the same film hardening agent, the liquids were coated to provide coated silver weights of 200 mg/m$^2$ onto supports which had been laminated on both sides with polyethylene to form Samples I-G to I-N.

Some of the samples I-G to I-N were stored for 3 days at 25° C., 60% RH and others were stored for 3 days at 40° C., 80% RH. The samples were then exposed to blue or green light through a continuous wedge in the same way as in Example 1 and then they were developed and processed in the way indicated below and magenta color images were obtained.

| Processing Procedure | Temperature | Time |
|---|---|---|
| Color development | 33° C. | 3 min. 30 sec. |
| Bleach-fix | 33° C. | 1 min. 30 sec. |
| Water wash | 25–35° C. | 3 minutes |
| Drying | 80° C. | |
| Color Development Bath Composition | | |
| Nitrilotriacetic acid.tri-sodium salt | | 2.0 g |
| Benzyl alcohol | | 15 ml |
| Diethyleneglycol | | 10 ml |
| Sodium sulfite | | 2.0 g |
| Potassium bromide | | 0.5 g |
| Hydroxylamine sulfate | | 3.0 g |
| 4-Amino-3-methyl-N-ethyl-N-[β-(methanesulfonamido)ethyl]-p-phenylenediamine sulfate | | 5.0 g |
| Sodium carbonate (mono-hydrate) | | 30 g |
| Water | | to make 1000 ml (pH 10.1) |
| Bleach-Fix Bath Composition | | |
| Ammonium thiosulfate (70 wt %) | | 150 ml |
| Sodium sulfite | | 15 g |
| (EDTA) iron ammonium salt | | 55 g |
| (EDTA).di-sodium salt | | 4 g |
| Water | | to make 1000 ml |

The optical densities for green light of the processed samples obtained in this way were measured and the results obtained were as shown in Table 2.

TABLE 2

| Sample No. | Magenta Coupler | Speed* Blue Light (intrinsic region) 25° C., 60% RH | Speed* Blue Light (intrinsic region) 40° C., 80% RH | Speed* Green Light (green sensitized region) 25° C., 60% RH | Speed* Green Light (green sensitized region) 40° C., 80% RH | Fog (Green light) | Green Sensitive Sensitizing Dye |
|---|---|---|---|---|---|---|---|
| G | (17) | 101 | 99 | 101 | 105 | 0.10 | |
| H | (23) | 100 | 98 | 102 | 103 | 0.10 | (A-7) |
| I | Comparative | 100 | 101 | 101 | 101 | 0.13 | |
| J | — | — | — | — | — | — | |
| K | (17) | 104 | 95 | 102 | 133 | 0.10 | |
| L | (23) | 100 | 96 | 101 | 125 | 0.12 | Comparative |

TABLE 2-continued

| Sample No. | Magenta Coupler | Speed* Blue Light (intrinsic region) 25° C., 60% RH | 40° C., 80% RH | Green Light (green sensitized region) 25° C., 60% RH | 40° C., 80% RH | Fog (Green light) | Green Sensitive Sensitizing Dye |
|---|---|---|---|---|---|---|---|
| M | Comparative | 101 | 104 | 100 | 102 | 0.18 | |
| N | — | — | — | — | — | — | |

*Relative value of the exposure which give a density of fog + 0.5. The value for sample I-I at 25° C., 60% RH was taken to be 100.

From these results it is clear that when a green sensitive sensitizing dye of the present invention is used with a pyrazoloazole magenta coupler, the change in speed is comparatively small even after storage under conditions of high temperature and humidity, but there was a marked fall in speed when the green sensitive sensitizing dye used for comparative purposes was used and, moreover, the minimum density part (fog) with green light was low in the case of the green sensitive sensitizing dyes of the present invention, but was very high with the green sensitive sensitizing dye used for comparative purposes with which there was also a deterioration in photographic performance. Hence, the green sensitive sensitizing dyes of the present invention are useful when a pyrazoloazole magenta coupler is used. It is considered that the variation in speed is due to a difference in the strength of adsorption of the sensitizing dye on the silver halide and it is thought that the sensitizing dyes of the present invention are strongly adsorbed.

EXAMPLE 3

Emulsion (p) was prepared using the same method as in Example 1 with the addition of 10 ml of TOP to 10.0 g of illustrative compound (17) as described in the Example.

Furthermore, emulsion (q) was prepared using the same method as in Example 1 using 10 ml of TOP alone.

On the other hand, each of the illustrative sensitizing dyes (A-1), (A-6) and (A-7) as green sensitive sensitizing dyes of the present invention, and the dye indicated below for comparative purposes, were added to a silver chlorobromide emulsion (Br 70 mol %, containing 66.0 g of silver per Kg) at the rate of $2.5\times10^{-4}$ mol per mol of silver chlorobromide emulsion, and all of each of the emulsions (p) and (q) was added to 135 g of this green sensitive emulsion.

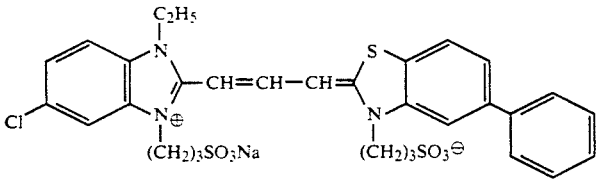

For Comparison

The coating liquids which had been prepared in this way were formed into a solution and aged by stirring for 4 hours in a constant temperature bath in exactly the same way as in Example 1, the same film hardening agent was added, and coated samples were prepared in the same way as before.

Each film sample was exposed to blue light or green light through a continuous wedge and then they were developed and processed in the way described in Example 1 and silver images were obtained.

The optical densities of each of the samples and measured and the results obtained were as shown in Table 1.

TABLE 3

| Sample No. | Magenta Coupler | Green Sens. Sensitizing Dye | Speed* Blue Light (Intrinsic Region) | Green Light (Sensitized Region) | Fog (Green Light) |
|---|---|---|---|---|---|
| P | (17) | (A-7) | 101 | 101 | 0.08 |
| Q | — | (A-7) | 100 | 100 | 0.07 |
| R | (17) | (C-1) | 100 | 101 | 0.09 |
| S | — | (C-1) | 100 | 100 | 0.07 |
| T | (17) | (A-16) | 102 | 102 | 0.08 |
| U | — | (A-16) | 100 | 100 | 0.07 |
| V | (17) | Comparative dye | 103 | 115 | 0.17 |
| W | — | Comparative dye | 100 | 100 | 0.09 |

*The relative value of the exposure which provides a density of fog + 0.5 for blue light or green light with respect to the systems (Samples I-Q, I-S, I-U and I-W) to which the emulsion (q) containing only oil had been added. The values for Samples I-Q, I-S, I-U and I-W were taken as 100 for comparison with those of the magenta coupler emulsions.

It is clear from the results shown in Table 3 that there was no loss of speed, in the emulsion systems in which a pyrazoloazole magenta coupler was used, with the green sensitive sensitizing dyes of the present invention and that increased fogging did not occur. On the other hand, the loss of speed was considerable with the green sensitizing dye for comparative purposes and increased fogging did occur.

From these facts it can be concluded that the application of combinations of pyrazoloazole magenta couplers with green sensitive sensitizing dyes of the present invention are advantageous.

EXAMPLE 4

A color printing paper which had the layer structure shown in Table 4 was prepared on a paper support which had been laminated on both sides with polyethylene. The coating liquid were prepared in the way described below.

Preparation of the First Layer coating Liquid

Ten ml of ethyl acetate and 4 ml of solvent (c) were added to 10 g of yellow coupler (a) and 2.3 g of color image stabilizer (b) to form a solution which was emulsified and dispersed in 90 ml of a 10% aqueous gelatin solution which contained 5 ml of 10% sodium dodecylbenzenesulfonate. On the other hand, the blue sensitive dye indicated below was added at the rate of $4\times10^{-4}$ sol per sol of silver bromide to a silver chlorobromide emulsion (1) (silver bromide content 80 mol %, silver content 70 g/Kg) to form a blue sensitive emulsion. This emulsion was mixed with the emulsified dispersion to form a solution, the gelatin concentration was adjusted so as to provide the composition shown in Table 1, and the first layer coating liquid was prepared in this way.

The silver chlorobromide emulsion (1) used in this example of the present invention was prepared in the way outlined below.

| | |
|---|---|
| Solution 1 | |
| $H_2O$ | 1000 ml |
| NaCl | 5.5 g |
| Gelatin | 25 g |
| Solution 2 | 20 ml |
| Sulfuric acid (1N) | |
| Solution 3 | |
| The compound indicated below (1%) | 2 ml |

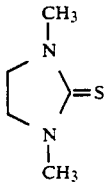

| | |
|---|---|
| Solution 4 | |
| KBr | 2.80 g |
| NaCl | 0.34 g |
| $H_2O$ | to make 140 ml |
| Solution 5 | |
| $AgNO_3$ | 5 g |
| $H_2O$ | to make 140 ml |
| Solution 6 | |
| KBr | 67.20 g |
| NaCl | 8.26 g |
| $K_2IrCl_6$ (0.001%) | 0.7 ml |
| $H_2O$ | to make 320 ml |
| Solution 7 | |
| $AgNO_3$ | 120 g |
| $NH_4NO_3$ (50%) | 2 ml |
| $H_2O$ | to make 320 ml |

Solution 1 was heated to 75° C. and solutions 2 and 3 were added. Solutions 4 and 5 were then added simultaneously over a period of 9 minutes. After a further 10 minutes solutions 6 and 7 were added simultaneously over a period of 45 minutes. Five minutes after this addition the temperature was lowered and the mixture was de-salted. Water and dispersed gelatin were added, the pH was adjusted to 6.2 and a mono-dispersed cubic silver chlorobromide emulsion containing 80 tool% silver bromide of which the average particle size was 1.01 μm and the variation coefficient (the value of the standard deviation divided by the average particle size, S/d) was 0.08, was obtained. Sodium thiosulfate was added to this emulsion and chemical sensitization was carried out to obtain optimal sensitization.

Silver chlorobromide emulsions (2) and (3) for the green sensitive and red sensitive emulsion layers of the present invention were prepared using the same method but with different quantities of the reagents, temperatures and time periods.

Emulsion (2) was a mono-dispersed cubic silver chlorobromide emulsion containing 75 mol % of silver bromide of which the particle size was 0.45 μm and the variation coefficient was 0.07, and emulsion (3) was a monodispersed cubic silver chlorobromide emulsion containing 70 mol % of silver bromide of which the particle size was 0.51 μm and the variation coefficient was 0.07.

The coating liquids for layers 2 to 7 were prepared using the same method as used for the first layer coating liquid. Moreover, 1-oxy-3,5-dichloro-s-triazine sodium salt was used in each layer as a gelatin hardening agent.

The spectral sensitizing agents used in each layer were as follows:

Blue Sensitive Emulsion Layer

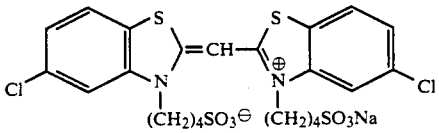

Green Sensitive Emulsion Layer As shown in Table 5

Red Sensitive Emulsion Layer

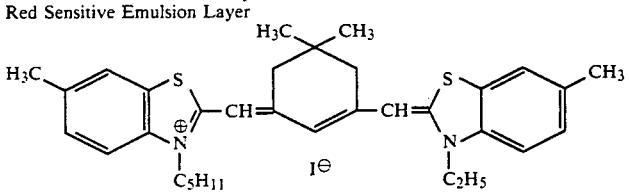

The following dyes were used as anti-irradiation dyes for each emulsion layer.

Green Sensitive Emulsion Layer: Dye (1)

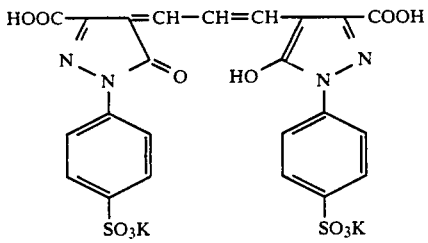

Red Sensitive Emulsion Layer: Dye (2)

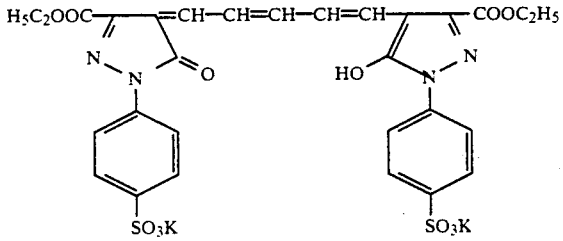

-continued

Dye For Spectral Speed Adjustment Purposes: Dye (3)

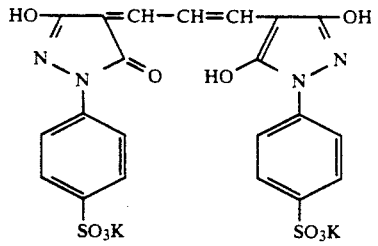

The structural formulae of the compounds such as the couplers, etc., used in this example of the present invention are indicated below.

(a) Yellow Coupler

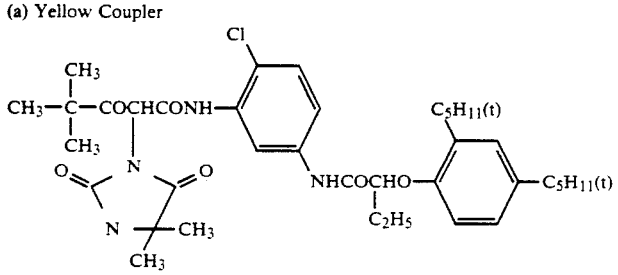

(b) Color Image Stabilizer

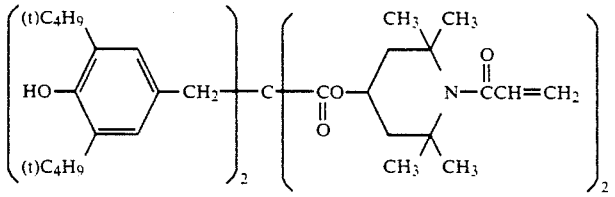

(c) Solvent $(C_9H_{19}O\frac{}{3}P{=}O$ (d) Anti-Color Mixing Agent

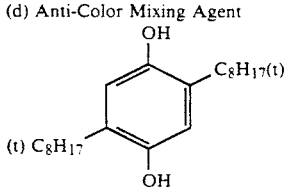

(e) Solvent:

A 1:1 mixture (mol ratio) of:

(1) (2)

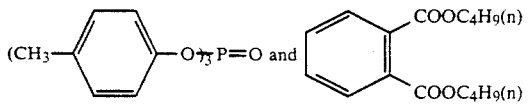

(f) Ultraviolet Absorber

A 1:5:3 mixture (mol ratio) of compounds of formulae (1), (2) and (3), respectively, below.

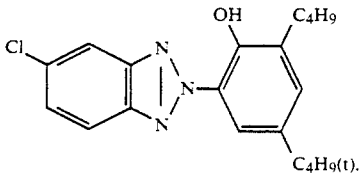

(1)

-continued

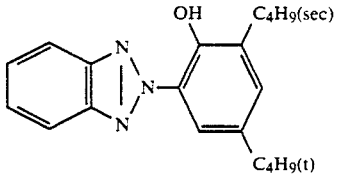

(2)

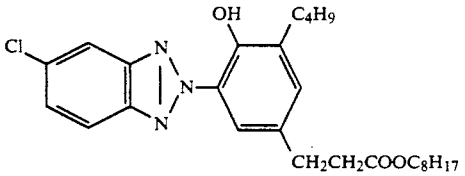

(3)

(g) Cyan Coupler

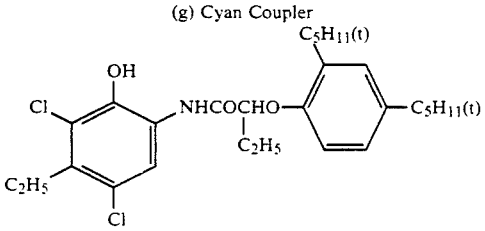

(h) Color Image Stabilizer

A 1:3:3 mixture of compounds of formulae (1), (2) and (3), respectively, below.

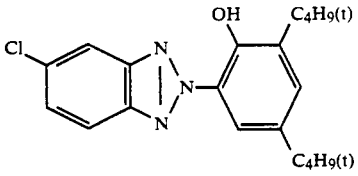

(1)

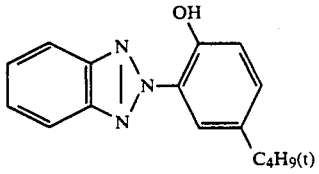

(2)

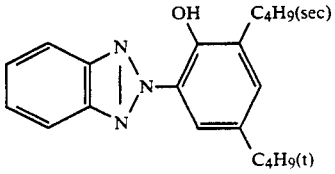

(3)

(i) Solvent

A 1:2 mixture of

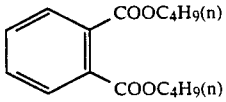

and $(C_9H_{19}O\frac{}{3}P{=}O)$ (1)

(j) Color Image Stabilizer

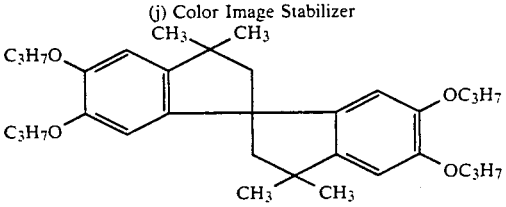

(2)

(k) Solvent $(C_8H_{17}O\frac{}{3}P{=}O)$

-continued (l) Solvent

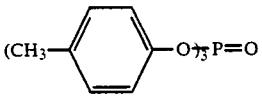

(m) Coupler for Comparison

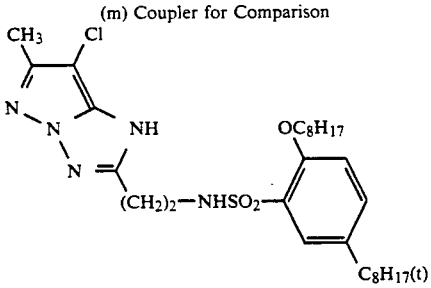

(n) Coupler for Comparison

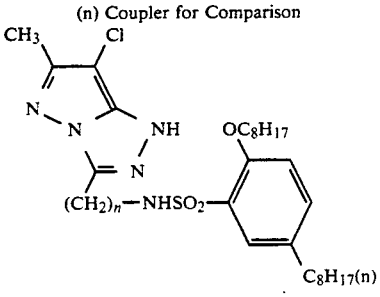

(o) Coupler for Comparison

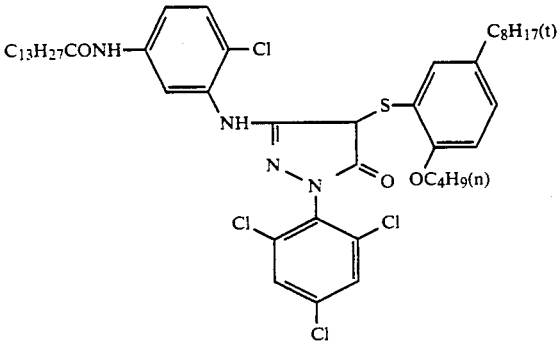

TABLE 4

| Layer | Principal Composition | | Amount Used |
|---|---|---|---|
| Seventh Layer (Protective Layer) | Gelatin | | 1.33 g/m$^2$ |
| | Acrylic modified polymer of polyvinyl alcohol (17% modification | | 0.17 g/m$^2$ |
| Sixth Layer (Ultraviolet Absorbing Layer) | Gelatin | | 0.62 g/m$^2$ |
| | Ultraviolet Absorber | (f) | $5.10 \times 10^{-4}$ mol/m$^2$ |
| | Solvent | (c) | 0.07 g/m$^2$ |
| Fifth Layer (Red Sensitive Layer) | Silver chlorobromide emulsion | (3) | Ag = 0.22 g/m$^2$ |
| | Gelatin | | 0.93 g/m$^2$ |
| | Cyan coupler | (g) | $7.05 \times 10^{-4}$ mol/m$^2$ |
| | Color image stabilizer | (h) | $5.20 \times 10^{-4}$ mol/m$^2$ |
| | Solvent | (i) | 0.25 g/m$^2$ |
| Fourth Layer (Ultraviolet Absorbing Layer) | Gelatin | | 1.43 g/m$^2$ |
| | Ultraviolet absorber | (f) | $1.50 \times 10^{-3}$ mol/m$^2$ |
| | Anti-color mixing agent | (d) | $1.50 \times 10^{-4}$ mol/m$^2$ |
| | Solvent | (c) | 0.22 g/m$^2$ |
| Third Layer (Green Sensitive Layer) | Silver chlorobromide emulsion | (2) | Ag = 0.15 g/m$^2$ |
| | Gelatin | | 1.80 g/m$^2$ |
| | Magenta coupler (as shown in | | $3.85 \times 10^{-4}$ mol/m$^2$ |

TABLE 4-continued

| Layer | Principal Composition | | Amount Used |
|---|---|---|---|
| | Table 5) | | |
| | Color image stabilizer | (j) | $3.85 \times 10^{-4}$ mol/m$^2$ |
| | Solvents | (k)/(l) | 0.43/0.27 g/m$^2$ |
| Second Layer (Anti-Color Mixing Layer) | Gelatin | | 0.92 g/m$^2$ |
| | Anti-color mixing agent | (d) | $2.33 \times 10^{-4}$ mol/m$^2$ |
| | Solvent | (e) | 0.15 g/m$^2$ |
| First Layer (Blue Sensitive Layer) | Silver chlorobromide emulsion | (1) | Ag = 0.26 g/m$^2$ |
| | Gelatin | | 1.83 g/m$^2$ |
| | Yellow coupler | (a) | $1.30 \times 10^{-3}$ mol/m$^2$ |
| | Color image stabilizer | (b) | $2.06 \times 10^{-4}$ mol/m$^2$ |
| | Solvent | (c) | 0.42 g/m$^2$ |
| Support | Polyethylene laminated paper (with white pigment ($TiO_2$, etc.) and ultramarine dye in the polyethylene on the first layer side) | | |

After adjusting the balance of the surface tensions and viscosities, the first to seventh layer coating liquids were coated simultaneously to form multi-layer silver halide photographic materials.

The couplers represented by the formula (I) or the formula (II) of the present invention and comparative couplers were used when preparing the third layer coating liquids and Samples II-A to II-P in which only the third layer differed, as shown in Table 5, were obtained.

TABLE 5

| | A | B | C | D | E | F | G | H | I | J | K | L | M | N | O | P |
|---|---|---|---|---|---|---|---|---|---|---|---|---|---|---|---|---|
| Type of Coupler | n | m | o | 17 | 17 | 17 | 17 | 17 | 17 | 6 | 6 | 6 | 17 | 17 | 17 | 17 |
| Type of Dye | 1 | 1 | 1 | 1 | 1 | 1 | 7 | 7 | 7 | 1 | 1 | 1 | Comp.* | Comp. | Comp. | Comp. |
| Amount of Dye (1) Used (mg/m$^2$) | 20 | 20 | 20 | 20 | 20 | 20 | 20 | 20 | 20 | 20 | 20 | 20 | 20 | 20 | 20 | 20 |
| Amount of Dye (2) Used (mg/m$^2$) | 13 | 13 | 13 | 13 | 26 | 26 | 13 | 26 | 26 | 13 | 26 | 26 | 13 | 26 | 13 | 26 |
| Amount of Dye (3) Used (mg/m$^2$) | 0 | 0 | 0 | 0 | 0 | 5 | 0 | 0 | 5 | 0 | 0 | 5 | 0 | 0 | 5 | 5 |

*Comp. Comparative dye of Example 2.

Photographic speeds were measured for Samples II-A to II-P obtained in this way using the same method as in Example 2. The results obtained are shown as relative values taking the speed of Sample II-D to be 100 in Table 6.

TABLE 6

| | A | B | C | D | E | F | G | H | I | J | K | L | M | N | O | P |
|---|---|---|---|---|---|---|---|---|---|---|---|---|---|---|---|---|
| *S(Peak)/$S_{500}$ nm | 3.0 | 3.1 | 3.0 | 3.0 | 2.5 | 3.0 | 3.0 | 2.5 | 3.0 | 3.0 | 2.5 | 3.0 | 1.8 | 1.9 | 1.5 | 1.5 |
| Speed | 133 | 100 | 110 | 100 | 160 | 170 | 100 | 100 | 170 | 100 | 160 | 170 | 188 | 301 | 191 | 310 |
| Fog | 0.09 | 0.10 | 0.11 | 0.10 | 0.10 | 0.10 | 0.10 | 0.10 | 0.10 | 0.10 | 0.10 | 0.10 | 0.12 | 0.12 | 0.12 | 0.12 |
| **rel $C_G$ | 98 | 95 | 100 | 100 | 98 | 100 | 100 | 98 | 100 | 100 | 98 | 100 | 93 | 93 | 92 | 91 |
| ***rel $C_R$ | 82 | 87 | 85 | 100 | 100 | 100 | 100 | 100 | 100 | 100 | 100 | 100 | 99 | 99 | 98 | 98 |
| | ←Comparative→ Examples | | | ← | ← | ← | This Invention | | | → | → | → | | ←Comparative→ Examples | | |

*S(Peak)/$S_{500}$ nm represents the ratio of the speed at peak wavelength and the speed at 500 nm when exposures are made with equal energy.
**rel $C_G$ is the relative green chroma.
***rel $C_R$ is the relative red chroma.

The numerical values signify the relative values of the exposures required to obtain a fixed density.

In order to compare speeds at the spectrally sensitized peak wavelength due to the sensitizing dye and at 500 nm, white light was broken down spectrally and exposures were made at various wavelengths with an accuracy of a half value width of 10 nm, the amounts of light were calculated as energies and the speed ratio was obtained. The results were as shown in Table 6.

The test described below was carried out in order to evaluate color reproduction. A color rendition chart produced by the Macbeth Co. was photographed using Super HR 100 color negative film made by the Fuji Photographic Film Co. and the film was subjected to standard CN-16 processing (Fuji color negative process and its chemicals) to provide an original negative. This was printed to provide matching greys on Samples II-A to II-P and the colored samples were monitored colorimetrically using a Model M-370 color analyzer made by Hitachi, and plots were made against the CIE 1964 even color space. The ratios of the distances from the origin for the red and green chroma in particular are shown in Table 6, taking the value for Sample II-D as 100. It is clear from the results shown in Table 6 that combinations of couplers and dyes of the present invention have high speed with little fogging and that the reproduction of red and green is excellent. Furthermore, it is clear that the green color reproduction improved as the value of the ratio S(peak)/$S_{500}$ increased.

EXAMPLE 5

The Silver Chlorobromide Emulsions in the photographic materials prepared in Example 4 were replaced by a silver chlorobromide emulsion having an increased average silver chloride content of 99 mol % and cubic grain structure with a silver bromide rich phase at the corner of the cube which had been prepared in the way described below, the sensitive materials III-A to III-P were prepared, and the same tests as used in Example 4 were carried out using the process indicated below.

The silver chlorobromide emulsion was prepared in the way indicated below.

| | |
|---|---|
| Solution 8 | |
| $H_2O$ | 1000 ml |
| NaCl | 3.3 g |
| Gelatin | 32 g |
| Solution 9 | 24 ml |
| Sulfuric acid (1N) | |
| Solution 10 | |
| The compound indicated below (1%) | 3 ml |

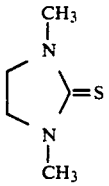

| | |
|---|---|
| Solution 11 | |
| NaCl | 11.00 g |
| $H_2O$ | to make 200 ml |
| Solution 12 | |
| $AgNO_3$ | 32.00 g |
| $H_2O$ | to make 200 ml |
| Solution 13 | |
| NaCl | 41.28 g |
| $K_2IrCl_6$ (0.001%) | 2.3 ml |
| $H_2O$ | to make 525 ml |
| Solution 14 | |
| $AgNO_3$ | 120.00 g |
| $H_2O$ | to make 525 ml |
| Solution 15 | |
| KBr | 4.48 g |
| NaCl | 0.55 g |
| $H_2O$ | to make 100 ml |
| Solution 16 | |
| $AgNO_3$ | 8.00 g |
| $H_2O$ | to make 100 ml |

Solution 8 was heated to 52° C. and solutions 9 and 10 were added. Solutions 11 and 12 were then added simultaneously over a period of 14 minutes. After a further 10 minutes solutions 13 and 14 were added simultaneously over a period of 15 minutes and then, after a further period of 10 minutes, solutions 15 and 16 wee added over a period of 5 minutes. Five minutes after this addition, the temperature was lowered and the mixture was de-salted. Water and dispersed gelatin were added, the pH was adjusted to 6.2 and a mono-dispersed cubic silver chlorobromide emulsion of which the average particle size was 0.48 μm and the variation coefficient (the value of the standard deviation divided by the average particle size, s/d) was 0.10, was obtained. Sodium thiosulfate was added to this emulsion at a temperature of 58° C., chemical sensitization was carried out for optimal sensitization, and the compound indicated below was added at a rate of $4\times10^{-4}$ mol per tool of silver halide and spectral sensitization was achieved.

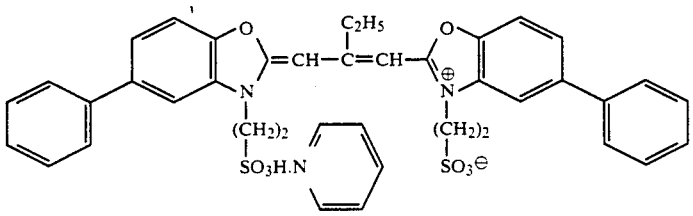

Furthermore, a silver chlorobromide emulsion was prepared by adding the compound indicated below at a rate of $5\times10^{-4}$ mol per mol of silver halide as a stabilizer.

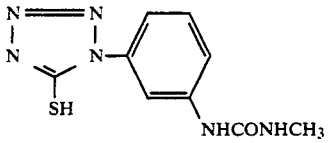

It was confirmed using the XPS method as described in "Hyohmen Bunseki-IMA, Auger denshi, Kohdenshi bunkoh no Ohyoh"]published by Kohdansha that the halogen composition of the silver chlorobromide emulsion obtained had an average silver chloride content of 99 mol % to 1 mol % of silver bromide and that the average silver bromide content of the surface was 5 mol %. Furthermore, it was confirmed using the X-ray diffraction method that the maximum silver bromide content of the silver bromide rich phase was about 50 mol %. Moreover, it was confirmed using an electron microscope and the EDX (Energy Dispersive X-ray Analysis) method as described by Hiroyoshi Fukushima in "Denshisen Micro-Analysis" published by Nikkan Kohgyo Shimbunsha (1987) that the morphological location of the silver bromide rich phase was at the corner of a cube. The literature states that the silver bromide content of localized phase present on the surface, particularly edges or corners of silver halide grains ununiformly or in an isolated state can be measured using a transmission electron microscope equipped with an EDX spectrometer under such condition that a diameter of aperture is about 0.1 to 0.2 μm with the accuracy of about 5 mol %.

The results obtained were similar to those obtained in Example 4, except that there are some improvement in color reproduction due to the presence of silver chlorobromide.

| Process | Processing Method Temperature | Time |
|---|---|---|
| Color development | 35° C. | 30 sec., 45 sec., 1 min. 30 sec. |
| Bleach-fix | 35° C. | 1 min. 30 sec. |
| Rinse | 28-35° C. | 1 min. 30 sec. |

| Composition of the Processing Baths Color Development Bath | |
|---|---|
| Water | 800 ml |
| Diethylenetriamine penta-acetic acid | 1.0 g |
| Sodium sulfite | 0.2 g |
| N,N-Diethylhydroxylamine | 4.2 g |
| Potassium bromide | 0.6 g |
| Sodium chloride | 1.5 g |
| Triethanolamine | 8.0 g |
| Potassium carbonate | 30 g |
| N-Ethyl-N-(β-methanesulfonamido-ethyl)-3-methyl-4-aminoaniline sulfate | 4.5 g |
| 4,4'-Diaminostilbene based brightening agent (Whitex 4, made by Sumitomo | 2.0 g |

-continued

| | |
|---|---|
| Chemicals, Co.) | |
| Water | to make 1000 ml |
| pH adjusted to 10.25 with KOH | |
| Bleach-Fix Bath Formulation | |
| Ammonium thiosulfate (54 wt %) | 150 ml |
| $Na_2SO_3$ | 15 g |
| $NH_4$[Fe(III)(EDTA)] | 55 g |
| EDTA.2Na | 4 g |
| Glacial acetic acid | 8.61 g |
| Water | to make 1000 ml (pH 5.4) |
| Rinse Bath Formulation | |
| EDTA.2Na.$2H_2O$ | 0.4 g |
| Water | to make 1000 ml (pH 7.0) |

The dyes obtained from the magenta couplers which can be represented by the formulae (I) and (II) of the present invention have little side absorption in the red and blue regions and they are color fast both in the dark and when illuminated. Furthermore, they are excellent in that there is little white base staining. However, photographic materials which have emulsion layers which contain these couplers within the scope of the present invention and these sensitizing dyes outside the scope of the present invention are liable to fogging and loss of speed during development and this trend becomes more pronounced as the coating liquid ages after preparation and when the coating photographic materials is in storage, and this is a series handicap in practical terms.

However, photographic materials which have emulsion layers which contain magenta couplers which can be represented by formulae (I) and (II) and sensitizing dyes selected from among those of formula (A), (B) or (C), and which have a speed at the peak wavelength of spectral sensitivity which is greater than the speed at 500 nm by a factor of at least 2, do not give rise to such problems of fogging or loss of speed, they have improved color chroma from true red into the magenta region and the colors of the green system are reproduced clearly, and it is possible to realize the excellent performance of these couplers. The effect achieved with the combinations of compounds of the present invention is surprising in that it was completely unknown in the past and could not have been deduced from other findings.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having on one side thereof at least one silver halide emulsion layer corresponding to each of the colors cyan, magenta, and yellow in which each of the colors cyan, magenta and yellow, respectively, are formed, wherein the layer which forms a magenta color is a green sensitive layer comprising:

(A) at least one coupler represented by formula (I) or formula (II) below:

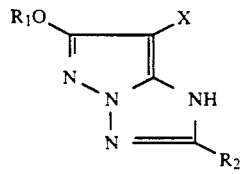

Formula (I)

wherein $R_1$ represents an alkyl group, an aryl group or a heterocyclic group;

$R_2$ represents a hydrogen atom or a substituent group; and

X represents a hydrogen atom or a coupling elimination group;

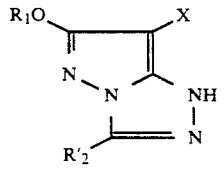

Formula (II)

where $R_1$ is defined the same as $R_1$ in formula (I);

$R_2$ represents an alkyl group, an aryl group, an alkylthio group, an arylthio group or a heterocyclic thio group; and X is defined the same as in formula (I); and (B) silver halide grains which have been spectrally sensitized in such a way that they have a peak sensitivity between 540 nm and 555 nm by at least one spectrally sensitizing dye represented by the formulae (A), (B) and (C) below:

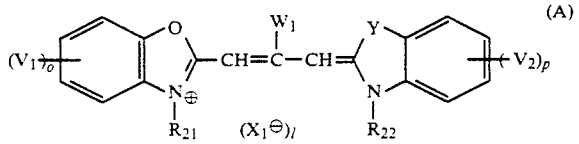

(A)

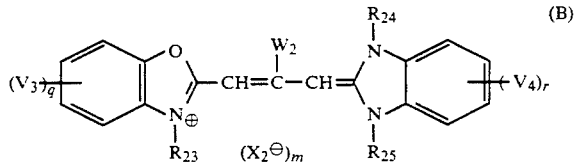

(B)

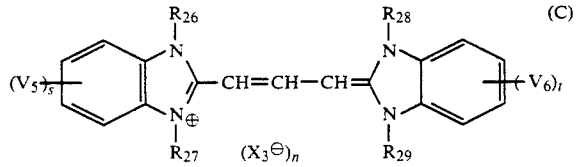

(C)

wherein $W_1$ and $W_2$ each represents a hydrogen atom or an alkyl group;

$V_1$, $V_2$, $V_3$ and $V_4$ each represents a hydrogen atom, a halogen atom, an alkyl group, an aryl group, an alkoxy group, an amido group, an alkoxycarbonyl group or a cyano group;

$V_1$ and $V_2$, or $V_3$ and $V_4$ may be the same or different, and they may represent a condensed benzene ring;

$V_5$ and $V_6$ may be the same or different and each represents a hydrogen atom, a halogen atom, an alkyl group, an alkoxy group, an amido group, an alkoxycarbonyl group or a cyano group;

the subscripts o, p, q, r, s, and t each represents an integer of from 1 to 4 and when the subscripts each represents an integer of from 2 to 4, $V_1$'s, $V_2$'s, $V_3$'s, or $V_4$'s may be the same or different.

$R_{21}$, $R_{22}$, $R_{23}$, $R_{24}$, $R_{26}$, $R_{27}$, $R_{28}$ and $R_{29}$ each represents an alkyl group or an aralkyl group, provided that at least one of $R_{21}$ and $R_{22}$; at least one of $R_{23}$, $R_{24}$, and $R_{25}$; or at least one of $R_{26}$, $R_{27}$, $R_{28}$, and $R_{29}$ represents an alkyl group or an aralkyl group which contains a sulfo group or a salt thereof, a carboxyl group or a salt thereof, or a hydroxyl group;

Y represents an oxygen atom or a sulfur atom;

$X_1$, $X_2$ and $X_3$ represent acid anions; and l, m and n represent 0 or 1, and l, m and n represents 0 when each compound is an intramolecular salt;

provided that the speed at the spectral sensitivity peak wavelength of said green sensitive layer is 2.5 times or more of the speed of 500 nm and, wherein said silver halide grains are cubic silver chlorobromide having an average silver chloride content of 99 mol % and silver bromide content of 1 mol % and having a silver bromide rich phase at the corner of the cube, wherein the average silver bromide content on the surface of the silver halide grains is about 5 mol % and the silver bromide rich phase has a maximum silver bromide content of about 50 mol %.

2. A silver halide color photographic material as in claim 1, wherein $R_2$ represents an alkyl group, an aryl group, an alkylthio group or an arylthio group; and $R'_2$ represents a substituted alkyl group or a substituted aryl group.

3. A silver halide color photographic material as in claim 1, wherein $R_2$ represents an alkyl group or an aryl group; and $R'_2$ *represents a substituted alkyl group.*

4. A silver halide color photographic material as in claim 1, wherein $W_1$ represents an ethyl group or a propyl group;

$W_2$ represents a hydrogen atom;

Y represents an oxygen atom;

$V_1$ represents a phenyl group or a condensed benzene ring; and $V_2$ represents a phenyl group, a condensed benzene ring, a chlorine atom or an alkoxy group.

5. A silver halide color photographic material as in claim 1, wherein $W_1$ represents an ethyl group or a propyl group;

$W_2$ represents a hydrogen atom;

Y represents a sulfur atom;

$V_2$ represents a hydrogen atom, a halogen atom, an alkyl group, a phenyl group, an alkoxy group or an amido group.

6. A silver halide color photographic material as in claim 1, wherein the coupler represented by formula (I) or formula (II) is a dimer in which one of $R_1$, $R_2$, and $R'_2$ represents a substituted or unsubstituted alkylene group or a substituted or unsubstituted phenylene group, or X represents a divalent group, in each of the formula (I) or formula (II) moieties in the dimer.

7. A silver halide color photographic material as in claim 1, wherein the coupler represented by formula (I) or formula (II) is bonded through a divalent group formed from $R_1$, $R_2$, $R'_2$ or X with a non-color forming ethylenic monomer which does not couple with an oxidation product of a primary aromatic amine developing agent.

8. A silver halide color photographic material as in claim 1, wherein the sensitizing dyes represented by the formulae (A), (B) and (C) are each present in each silver halide emulsion layer in an amount in the range of from $1\times10^{-6}$ mol to $5\times10^{-3}$ mol per mol of silver halide in the silver halide emulsion layer.

9. A silver halide color photographic material as in claim 1, wherein the couplers represented by formula (I) and formula (II) are present in the color photographic material in an amount in the range of from $2\times10^{-}$mol to $5\times10^{-1}$ mol per tool of silver halide in the color photographic material.

10. A silver halide color photographic material as in claim 1, wherein the speed at the spectral sensitivity peak wavelength of said green sensitive layer is 2.5 times or more of the speed at 500 nm.

11. A silver halide color photographic material as in claim 1, wherein each of $V_3$ and $V_5$ represent phenyl groups or chlorine atoms.

12. A silver halide color photographic material as in claim 1, wherein each of $V_3$ and $V_5$ represent condensed benzene rings.

13. A silver halide color photographic material as in claim 1, wherein each of $V_4$ and $V_6$ are trifluoromethyl groups, chlorine atoms, alkoxycarbonyl groups or cyano groups.

14. A silver halide color photographic material as in claim 1, wherein there is either one chlorine atom substituted in each of the two benzotriazolyl groups in formula (C) or two chlorine atoms substituted in one of these groups.

15. A silver halide color photographic material as in claim 1, wherein $R_{21}$, $R_{22}$, $R_{23}$, $R_{24}$, $R_{25}$, $R_{26}$, $R_{27}$, $R_{28}$ and $R_{29}$ represent alkyl groups which have from 1 to 5 carbon atoms and aralkyl groups which have from 7 to 10 carbon atoms.

16. A silver halide color photographic material as in claim 1, wherein $R'_2$ represents a substituted alkyl group.

17. A silver halide color photographic material as in claim 1, wherein the speed at the spectral sensitivity peak wavelength of said green sensitive layer is thrice or more of the speed at 500 nm.

18. A silver halide color photographic material as in claim 1, wherein said green sensitive layer further comprises color image stabilizers represented by formula below

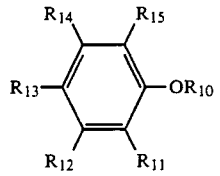

wherein $R_{10}$ represents a hydrogen atom, an alkyl group, an aryl group or a heterocyclic group, $R_{11}$, $R_{12}$, $R_{14}$ and $R_{15}$ each represents a hydrogen atom, a hydroxyl group, an alkyl group, an aryl group, an alkoxy group, an acylamino group, an alkoxycarbonyl group, or a sulfonamido group, and $R_{13}$ represents an alkyl group, a hydroxyl group, an aryl group or an alkoxy group.

19. A silver halide color photographic material as in claim 18, wherein $R_{10}$ and $R_{11}$ undergo ring closure to form a 5- or 6-membered ring.

20. A silver halide color photographic material as in claim 18, wherein $R_{10}$ and $R_{11}$ undergo ring closure to form a methylenedioxy ring.

21. A silver halide color photographic material as in claim 18, wherein $R_{13}$ and $R_{14}$ undergo ring closure to form a 5-membered hydrocarbon ring.

22. A silver halide color photographic material comprising a support having on one side thereof at least one silver halide emulsion layer corresponding to each of the colors cyan, magenta, and yellow in which each of the colors cyan, magenta and yellow, respectively, are formed, wherein the layer which forms a magenta color is a green sensitive layer comprising:

(A) at least one coupler represented by formula (I) or formula (II) below:

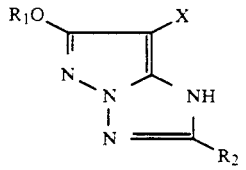

Formula (I)

wherein $R_1$ represents an alkyl group, an aryl group or a heterocyclic group;

$R_2$ represents a hydrogen atom or a substituent group; and

X represents a hydrogen atom or a coupling elimination group;

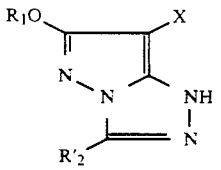

Formula (II)

wherein $R_1$ is defined the same as $R_1$ in formula (I);

$R_2$ represents an alkyl group, an aryl group, an alkylthio group, an arylthio group or a heterocyclicthio group; and X is defined the same as in formula (I); and (B) silver halide grains which have been spectrally sensitized in such a way that they have a peak sensitivity between 540 nm and 555 nm by at least one spectrally sensitizing dye represented by the formulae (A), (B) and (C) below:

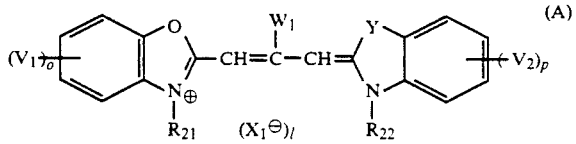

(A)

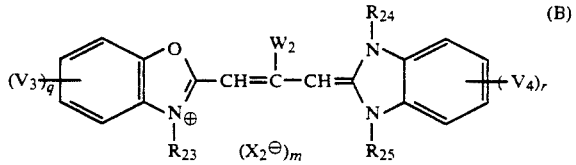

(B)

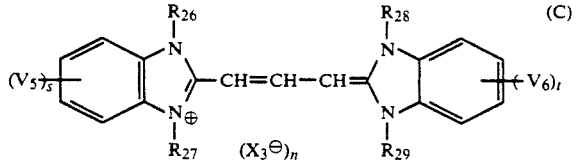

(C)

wherein $W_1$ and $W_2$ each represents a hydrogen atom or an alkyl group;

$V_1$, $V_2$ and $V_3$ and $V_4$ each represents a hydrogen atom, a halogen atom, an alkyl group, an aryl group, an alkoxy group, an amido group, an alkoxycarbonyl group or a cyano group;

$V_1$ and $V_2$, or $V_3$ and $V_4$ may be the same or different, and they may represent a condensed benzene ring;

$V_5$ and $V_6$ may be the same or different and each represents a hydrogen atom, a halogen atom, an alkyl group, an alkoxy group, an amido group, an alkoxycarbonyl group or a cyano group;

the subscripts o, p, q, r, s, and t each represents an integer of from 1 to 4 and when the subscripts each represents an integer of from 2 to 4, $V_1$'s, $V_2$'s, $V_3$'S, or $V_4$'s may be the same or different;

$R_{21}$, $R_{22}$, $R_{23}$, $R_{24}$, $R_{25}$, $R_{26}$, $R_{27}$, $R_{28}$ and $R_{29}$ each represents an alkyl group or an aralkyl group, provided that at least one of $R_{21}$ and $R_{22}$; at least one of $R_{23}$, $R_{24}$ and $R_{25}$; or at least one of $R_{26}$, $R_{27}$, $R_{28}$, and $R_{29}$ represents an alkyl group or an aralkyl group which contains a sulfo group or a salt thereof, a carboxyl group or a salt thereof, or a hydroxyl group;

Y represents an oxygen atom or a sulfur atom;

$X_1$, $X_2$ and $X_3$ represent acid anions; and l, m and n represents 0 or 1, and l, m and n represents 0 when each compound is an intramolecular salt;

provided that the speed at the spectral sensitivity peak wavelength of said green sensitive layer is 2.5 times or more of the speed at 500 nm and, wherein said silver halide grains are cubic silver chlorobromide having an average silver chloride content of 99 mol % and silver bromide content of 1 mol % and having a silver bromide rich phase at the corner of the cube, wherein the average silver bromide content on the surface of the silver halide grains is about 5 mol % and the silver bromide rich phase has a maximum silver bromide content of about 50 mol % and wherein said silver halide grains have an average particle size of 0.48 μm and a variation coefficient of 0.10.

* * * * *